US011560746B2

(12) United States Patent
Bernhagen et al.

(10) Patent No.: US 11,560,746 B2
(45) Date of Patent: Jan. 24, 2023

(54) SLIDE OPERATOR ASSEMBLIES AND COMPONENTS FOR FENESTRATION UNITS

(71) Applicant: Pella Corporation, Pella, IA (US)

(72) Inventors: Todd A. Bernhagen, Pella, IA (US); Ted L. Hansen, Pella, IA (US); Paul D. Shroder, Pella, IA (US)

( * ) Notice: Subject to any disclaimer, the term of this patent is extended or adjusted under 35 U.S.C. 154(b) by 195 days.

(21) Appl. No.: 16/883,481

(22) Filed: May 26, 2020

(65) Prior Publication Data

US 2020/0370355 A1 Nov. 26, 2020

Related U.S. Application Data

(60) Provisional application No. 62/852,455, filed on May 24, 2019.

(51) Int. Cl.

| | |
|---|---|
| ***E05F 11/06*** | (2006.01) |
| ***E05F 11/34*** | (2006.01) |
| ***E05F 11/36*** | (2006.01) |
| ***E06B 3/36*** | (2006.01) |
| *E05F 11/24* | (2006.01) |

(52) U.S. Cl.

CPC ..... *E05F 11/06* (2013.01); *E06B 3/36* (2013.01); *E05F 11/24* (2013.01); *E05F 11/34* (2013.01); *E05Y 2900/148* (2013.01)

(58) Field of Classification Search

CPC . E05F 11/10; E05F 11/16; E05F 11/14; E05F 11/04; E05F 11/06; E05F 11/24; E05F 11/34; E05Y 2900/148; E05Y 2201/244; E06B 3/36; E06B 3/38

See application file for complete search history.

(56) References Cited

U.S. PATENT DOCUMENTS

| | | | |
|---|---|---|---|
| 89,606 | A | 5/1869 | Strongfllow |
| 105,287 | A | 7/1870 | Wood |
| 262,530 | A | 8/1882 | Zacherl |
| 281,865 | A | 7/1883 | Goodwin |
| 327,858 | A | 10/1885 | Bradford |
| 426,792 | A | 4/1890 | Foote |
| 489,442 | A | 1/1893 | Whetter |
| 501,622 | A | 7/1893 | Lee |
| 685,466 | A | 10/1901 | Bradshaw |
| 718,007 | A | 1/1903 | Linn |
| 763,240 | A | 6/1904 | Aupke |
| 779,801 | A | 1/1905 | Prden |
| 798,369 | A | 8/1905 | Stutenroth |
| 798,544 | A | 8/1905 | Van Horssen |
| 812,097 | A | 2/1906 | Stanley et al. |
| 820,960 | A | 5/1906 | Erb |
| 820,961 | A | 5/1906 | Erb |
| 908,394 | A | 12/1908 | Corbeille |
| 928,526 | A | 7/1909 | Loper |
| 956,963 | A | 5/1910 | Harmuth |

(Continued)

FOREIGN PATENT DOCUMENTS

| | | | |
|---|---|---|---|
| CA | 2988151 | A1 | 6/2018 |
| CN | 101080542 | A | 11/2007 |

(Continued)

*Primary Examiner* — Justin B Rephann

(74) *Attorney, Agent, or Firm* — Faegre Drinker Biddle & Reath; Johnathon Webb; Victor Jonas

(57) ABSTRACT

Slide operator assemblies and components for fenestration units, as well as associated methods of manufacture and use thereof.

21 Claims, 27 Drawing Sheets

(56) References Cited

U.S. PATENT DOCUMENTS 984,669 A 2/1911 Hedstrom
1,082,663 A 12/1913 Viragh
1,134,203 A 4/1915 Jones
1,184,148 A 5/1916 Teisseire
1,193,211 A 8/1916 Webster
1,198,138 A 9/1916 Lovell
1,214,602 A 2/1917 Smith
1,220,675 A 3/1917 Parson
1,222,293 A 4/1917 Iman
1,282,490 A 10/1918 Sullwold
1,313,401 A 8/1919 Mann
1,325,790 A 12/1919 Kleinschmidt
1,327,441 A 1/1920 Mesker et al.
1,358,121 A 11/1920 Smith
1,361,913 A 12/1920 Sebastian
1,397,859 A 11/1921 Dickens
1,445,267 A 2/1923 Card
1,469,331 A 10/1923 Chester et al.
1,494,948 A 5/1924 Bujack
1,511,363 A 10/1924 Pierson
1,533,725 A 4/1925 Davenport
1,538,222 A 5/1925 Smith
1,601,773 A 10/1926 Sasgen
1,605,883 A 11/1926 Wheelock
1,644,814 A 10/1927 Barr
1,649,861 A 11/1927 Schneider
1,651,697 A 12/1927 James
1,664,322 A 3/1928 Reese
1,694,886 A 12/1928 McClellan
1,707,888 A 4/1929 White
1,708,556 A 4/1929 Storms
1,835,558 A 12/1931 Campbell
1,899,466 A 2/1933 Kistner
1,924,557 A 8/1933 Johnson
1,988,810 A 1/1935 Ross
2,405,887 A 8/1946 Hoffman
2,788,098 A 4/1957 Bianco
3,103,351 A 9/1963 Ahlgren
3,117,351 A 1/1964 Ahlgren
3,157,224 A 11/1964 Spargur et al.
3,330,071 A 7/1967 Kubisiak
3,337,992 A 8/1967 Tolson
3,456,387 A 7/1969 Tolson
4,037,483 A 7/1977 Nadal
4,377,969 A 3/1983 Nelson
4,382,349 A 5/1983 Dunphy et al.
4,703,960 A 11/1987 Lense
4,937,976 A * 7/1990 Tucker ..... E05F 11/06 49/260
5,144,770 A 9/1992 Kraus et al.
5,313,737 A 5/1994 Midas
5,502,925 A 4/1996 Gorrell
5,509,234 A 4/1996 Klimek et al.
5,531,045 A 7/1996 Piltingsrud
5,553,420 A 9/1996 Klimek
5,568,702 A 10/1996 Frank et al.
5,568,703 A 10/1996 Frank et al.
5,615,522 A 4/1997 Tomanek
5,636,476 A 6/1997 Eikmeier et al.
5,682,710 A 11/1997 Davies et al.
5,687,506 A 11/1997 Davies et al.
5,715,631 A 2/1998 Kailian et al.
5,775,028 A 7/1998 Lambert
5,813,171 A 9/1998 Piltingsrud
5,815,984 A 10/1998 Sheets et al.
5,826,377 A 10/1998 Simson et al.
5,839,229 A 11/1998 Briggs et al.
5,881,498 A 3/1999 Goggin et al.
5,937,582 A 8/1999 Taylor
5,946,857 A 9/1999 Davies et al.
5,996,668 A 12/1999 Deblock et al.
6,076,304 A 6/2000 Carrier
6,122,863 A 9/2000 Tippin et al.
6,139,070 A 10/2000 Piltingsrud
6,161,336 A 12/2000 Ziv-Av
6,209,364 B1 4/2001 Collet et al.
6,209,610 B1 4/2001 Davies et al.
6,267,168 B1 7/2001 Davies et al.
6,270,175 B1 8/2001 Sfeir
6,314,681 B1 11/2001 Moody
6,328,090 B1 12/2001 Anderson et al.
D453,214 S 1/2002 Komatsubara et al.
6,343,436 B1 2/2002 Milano et al.
6,354,639 B1 3/2002 Minter et al.
6,367,853 B1 4/2002 Briggs
6,381,080 B1 4/2002 Holdener et al.
6,384,990 B1 5/2002 Holdener et al.
6,405,781 B2 6/2002 Davies et al.
6,425,611 B1 7/2002 Minter et al.
6,431,620 B2 8/2002 Tremblay et al.
6,442,898 B1 9/2002 Wu
6,446,391 B1 * 9/2002 Timothy ..... E05F 11/16 49/330
6,460,294 B1 10/2002 Harkins
6,484,445 B2 11/2002 Chang
6,546,671 B2 4/2003 Mitchell et al.
6,601,633 B2 8/2003 Sun et al.
6,619,707 B2 9/2003 Sucu et al.
6,637,287 B2 10/2003 Griffin
6,679,002 B2 1/2004 Davies et al.
6,736,185 B2 5/2004 Smith et al.
6,782,661 B2 8/2004 Manzella
6,817,142 B2 11/2004 Marshik
6,871,884 B2 3/2005 Hoffmann et al.
6,871,885 B2 3/2005 Goldenberg et al.
6,890,028 B2 5/2005 Pal et al.
6,915,608 B2 7/2005 Labarre
6,926,363 B2 8/2005 Yamashita
6,968,646 B2 11/2005 Goldenberg et al.
7,013,603 B2 3/2006 Eenigenburg et al.
7,017,301 B2 3/2006 Balbo Di Vinadio
7,021,360 B2 4/2006 Schroder et al.
7,024,821 B2 4/2006 Lu
7,036,274 B2 5/2006 Carrier
7,048,312 B2 5/2006 Brunner
7,066,233 B2 6/2006 Scharff et al.
7,100,327 B2 9/2006 Rangabasyam et al.
7,147,255 B2 12/2006 Goldenberg et al.
7,159,908 B2 1/2007 Liang
7,168,475 B2 1/2007 Colson et al.
7,174,941 B2 2/2007 Schroder et al.
7,216,401 B2 5/2007 Bae
7,246,411 B2 7/2007 Campbell et al.
7,246,840 B2 7/2007 Gates et al.
7,257,864 B2 8/2007 Liang et al.
D558,024 S 12/2007 Tremble et al.
7,305,800 B1 12/2007 Calfee
D559,078 S 1/2008 Baczuk et al.
D560,112 S 1/2008 Baczuk et al.
7,325,359 B2 2/2008 Vetter
7,396,054 B2 7/2008 Carrier
7,412,800 B2 8/2008 Maier
7,441,811 B2 10/2008 Lawrence
7,464,619 B2 12/2008 Vetter
7,543,623 B2 6/2009 Allardyce et al.
7,614,184 B2 11/2009 Rebel et al.
7,617,707 B2 11/2009 Chiang
7,913,456 B2 3/2011 Balbo Di Vinadio
7,954,313 B2 6/2011 Hirata et al.
7,963,577 B2 6/2011 Wolf
7,971,392 B2 7/2011 Seo
8,046,954 B2 11/2011 Curtis et al.
8,051,604 B2 11/2011 Diekmann et al.
8,087,322 B1 1/2012 Morris
8,156,612 B2 4/2012 Tadanobu
8,171,673 B2 5/2012 Helms
8,182,001 B2 5/2012 Tremble et al.
8,281,458 B2 10/2012 Balbo Di Vinadio
8,308,204 B2 11/2012 Lindgren et al.
8,336,930 B2 12/2012 Liang et al.
8,347,936 B2 1/2013 Martin et al.
8,376,019 B2 2/2013 Van et al.
8,418,404 B2 4/2013 Gramstad et al.
8,434,265 B1 5/2013 Campbell et al.

(56) References Cited

U.S. PATENT DOCUMENTS 8,448,996 B2 5/2013 Lake et al.
8,474,186 B2 7/2013 Dufour et al.
8,490,330 B2 7/2013 Lund et al.
8,511,724 B2 8/2013 Liang et al.
8,550,506 B2 10/2013 Nakanishi et al.
8,602,463 B2 12/2013 Keighley et al.
8,657,347 B2 2/2014 Liang et al.
8,683,746 B2 4/2014 Lambertini
8,707,621 B2 4/2014 Curtis et al.
8,726,572 B2 5/2014 Derham
8,727,395 B2 5/2014 Nania
8,733,021 B2 5/2014 Lambertini
8,769,872 B2 7/2014 Maltaverne et al.
8,789,857 B2 7/2014 Liang et al.
D712,280 S 9/2014 Radomyselski et al.
8,899,632 B2 12/2014 Tremble et al.
8,919,699 B2 12/2014 Kress et al.
8,925,150 B2 1/2015 Pacini
8,935,887 B2 1/2015 Cavalcante
9,062,487 B2 6/2015 Perry et al.
9,109,384 B2 8/2015 Minter et al.
9,163,437 B1 10/2015 Lawrence
9,169,691 B2 10/2015 Berger
9,234,374 B2 1/2016 Wolf et al.
9,273,763 B2 3/2016 Evensen
9,441,714 B2 9/2016 Hsu et al.
9,441,840 B2 9/2016 Deng
D795,848 S 8/2017 Zheng et al.
9,745,784 B1 8/2017 Lawrence
9,759,001 B2 9/2017 Bisang et al.
9,772,010 B2 9/2017 Dodge et al.
9,784,025 B2 10/2017 Minter et al.
D808,256 S 1/2018 Muller
9,889,725 B2 2/2018 Boesel et al.
10,119,318 B1 11/2018 Wolf et al.
10,676,977 B2 6/2020 Erickson et al.
10,876,343 B2 12/2020 Erickson et al.
11,002,057 B1 5/2021 Micinski et al.
2001/0000878 A1 5/2001 Davies et al.
2001/0011579 A1 8/2001 Davies et al.
2001/0019211 A1 9/2001 Tremblay et al.
2001/0027621 A1 10/2001 Davies et al.
2002/0066162 A1 6/2002 Klompenburg et al.
2002/0116874 A1 8/2002 Marshik
2002/0119000 A1 8/2002 Gledhill
2002/0124468 A1 9/2002 Manzella
2002/0144465 A1 10/2002 Chang
2002/0145291 A1 10/2002 Goldenberg et al.
2002/0162223 A1 11/2002 Reichert
2002/0167180 A1 11/2002 Sucu et al.
2003/0014920 A1 1/2003 Lu
2003/0024168 A1 2/2003 Mitchell et al.
2003/0047949 A1 3/2003 Brunner
2003/0079414 A1 5/2003 Rangabasyam et al.
2003/0089190 A1 5/2003 Griffin
2003/0110699 A1 6/2003 Eenigenburg et al.
2003/0110701 A1 6/2003 Dawson
2003/0122409 A1 7/2003 Pal et al.
2003/0159477 A1 8/2003 Hoffmann et al.
2003/0172591 A1 9/2003 Labarre
2004/0011475 A1 1/2004 Smith et al.
2004/0011476 A1 1/2004 Schroder et al.
2004/0036299 A1 2/2004 Goldenberg et al.
2004/0036300 A1 2/2004 Goldenberg et al.
2004/0128914 A1 7/2004 Hempelmann
2004/0183314 A1 9/2004 Klompenburg et al.
2004/0216381 A1 11/2004 Clavet
2004/0216541 A1 11/2004 Vetter
2004/0245801 A1 12/2004 Gates et al.
2004/0261320 A1 12/2004 Sullivan
2005/0011049 A1 1/2005 Muir
2005/0022941 A1 2/2005 Di Vinadio
2005/0046260 A1 3/2005 Yamashita
2005/0055804 A1 3/2005 Liang et al.
2005/0072075 A1 4/2005 Maier
2005/0072088 A1 4/2005 Colson et al.
2005/0078818 A1 4/2005 Bae
2005/0103449 A1 5/2005 Scharff et al.
2005/0132532 A1 6/2005 Campbell et al.
2005/0198905 A1 9/2005 Carrier
2005/0218658 A1 10/2005 Lawrence
2005/0262769 A1 12/2005 Vetter
2005/0284584 A1 12/2005 Schroder et al.
2006/0032143 A1 2/2006 Johnson
2006/0053692 A1 3/2006 Rebel et al.
2006/0087130 A1 4/2006 Liang
2006/0118250 A1 6/2006 Jin et al.
2006/0130980 A1 6/2006 Gromotka et al.
2006/0169418 A1 8/2006 Gromotka et al.
2006/0218864 A1 10/2006 Blomqvist
2006/0225847 A1 10/2006 Davies et al.
2006/0244269 A1 11/2006 Rotondi
2006/0244270 A1 11/2006 Rotondi
2006/0260431 A1 11/2006 Gill
2007/0020091 A1 1/2007 Giaimo et al.
2007/0020092 A1 1/2007 Giaimo et al.
2007/0040396 A1 2/2007 Carrier
2007/0137110 A1 6/2007 Liles
2007/0137798 A1 6/2007 Colson et al.
2007/0158953 A1 7/2007 Liang
2008/0000164 A1 1/2008 Erickson et al.
2008/0001413 A1 1/2008 Lake et al.
2008/0029226 A1 2/2008 Huang
2008/0040978 A1 2/2008 Diekmann et al.
2008/0092446 A1 4/2008 Bienek
2008/0120915 A1 5/2008 Flores
2008/0129054 A1 6/2008 Tremble et al.
2008/0178424 A1 7/2008 Tuller
2008/0229667 A1 9/2008 Dufour et al.
2008/0245488 A1 10/2008 Colson et al.
2008/0250719 A1 10/2008 Griffin et al.
2008/0256874 A1 10/2008 Curtis et al.
2009/0013605 A1 1/2009 Seo
2009/0025301 A1 1/2009 Di Vinadio
2009/0079202 A1 3/2009 Wolf
2009/0120070 A1 5/2009 Hirata et al.
2009/0146436 A1 6/2009 Lindgren et al.
2010/0050524 A1 3/2010 Helms
2010/0089190 A1 4/2010 Busch
2010/0139039 A1 6/2010 Balbo Di Vinadio
2010/0192643 A1 8/2010 Liang et al.
2010/0269987 A1 10/2010 Martin et al.
2010/0276947 A1 11/2010 Keighley et al.
2010/0293748 A1 11/2010 Yamashita
2010/0307064 A1 12/2010 Lambertini
2010/0327610 A1 12/2010 Nakanishi et al.
2011/0062727 A1 3/2011 Liang et al.
2011/0068124 A1 3/2011 Reynolds et al.
2011/0298225 A1 12/2011 Liang et al.
2012/0023826 A1 2/2012 Curtis et al.
2012/0068478 A1 3/2012 Nania
2012/0167469 A1 7/2012 Maltaverne et al.
2012/0174487 A1 7/2012 Lambertini
2012/0180392 A1 7/2012 Lambertini
2012/0297683 A1 11/2012 Cavalcante
2012/0313387 A1 12/2012 Liang et al.
2013/0104458 A1 5/2013 Leung et al.
2013/0111819 A1 5/2013 Tremble et al.
2013/0214545 A1 8/2013 Wolf et al.
2013/0220043 A1 8/2013 Hsu et al.
2013/0256458 A1 10/2013 Kress et al.
2013/0312331 A1 11/2013 Bourgoin
2013/0312645 A1 11/2013 Deng
2014/0007378 A1 1/2014 Pacini
2014/0007720 A1 1/2014 Evensen
2014/0069016 A1 3/2014 Perry et al.
2014/0259940 A1 9/2014 Meves et al.
2015/0013230 A1 1/2015 Balbo Di Vinadio
2015/0114176 A1 4/2015 Bisang et al.
2015/0191956 A1 7/2015 Minter et al.
2015/0197976 A1 7/2015 Talbot
2016/0145911 A1 5/2016 Boesel et al.
2016/0369549 A1 12/2016 Dodge et al.
2017/0067644 A1 3/2017 Deng

(56) References Cited

U.S. PATENT DOCUMENTS

| | | | |
|---|---|---|---|
| 2017/0107750 | A1 | 4/2017 | Carrier |
| 2017/0198512 | A1 | 7/2017 | Gramstad |
| 2017/0306682 | A1 | 10/2017 | Mcinnis et al. |
| 2018/0163450 | A1 | 6/2018 | Erickson et al. |
| 2018/0163451 | A1 | 6/2018 | Erickson et al. |
| 2020/0131832 | A1 | 4/2020 | Hagen et al. |
| 2021/0079707 | A1 | 3/2021 | Erickson et al. |
| 2022/0205299 | A1 | 6/2022 | Bernhagen et al. |

FOREIGN PATENT DOCUMENTS

| | | | |
|---|---|---|---|
| CN | 101131061 | A | 2/2008 |
| DE | 20316561 | U1 | 1/2004 |
| DE | 102007002650 | A1 | 7/2008 |
| DE | 102009007686 | A1 | 4/2010 |
| DE | 102010000158 | A1 | 9/2010 |
| EP | 0740041 | A1 | 10/1996 |
| EP | 1092829 | A2 | 4/2001 |
| EP | 1241311 | A2 | 9/2002 |
| EP | 1505242 | A1 | 2/2005 |
| EP | 2735677 | A1 | 5/2014 |
| GB | 2475507 | A | 5/2011 |
| GB | 2520340 | A | 5/2015 |

* cited by examiner

SLIDE OPERATOR ASSEMBLIES AND COMPONENTS FOR FENESTRATION UNITS

REFERENCE TO RELATED APPLICATION

This application claims the benefit of U.S. Provisional Application Ser. No. 62/852,455 filed May 24, 2019, which is incorporated herein by reference in its entirety and for all purposes.

FIELD

The present disclosure relates generally to fenestration units. In particular, the disclosure relates to slide operator assemblies and components for fenestration units.

BACKGROUND

Casement windows have a sash that is attached to a frame by one or more hinges at a side of the frame, or window jamb. Window sashes hinged at the top, or head of the frame, are referred to as awning windows, and sashes hinged at the bottom, or sill of the frame, are called hopper windows. Any of these configurations may be referred to simply as hinged fenestration units, or pivoting fenestration units.

Typically, such hinged fenestration units are opened by simply pushing on the sash directly, or through the use of hardware including cranks, levers, or cam handles. In various examples, operators are placed around hand height or at the bottom/sill of the unit. Such operators typically require a user to impart a swinging or rotational motion with some form of crank handle. This type of operator hardware may have one or more undesirable traits for some hinged fenestration unit designs, including requisite location (e.g., sill, interiorly protruding), associated appearance (e.g., crank style), or form of operability (e.g., rotating/cranking/swinging).

SUMMARY

Various examples from this disclosure relate to sliding operator assemblies and associated fenestration units, systems, components and methods of use and assembly. Some aspects relate to sliding operator assemblies that transition a first, linear actuation force along a first axis (e.g., vertical) to a second actuation force along a second axis (e.g., horizontal) that is angularly offset from the first axis to cause a drive mechanism to impart opening and closing forces, respectively, on the sash. Some examples relate to belt-, twisted wire-, or band-drive sliding operator assemblies. Advantages include the ability to have a low-profile actuator that does not substantially project into the viewing area or otherwise impede a view of the fenestration unit, has reduced operating forces, and/or has enhanced handle positioning, although any of a variety of additional or alternative features and advantages are contemplated and will become apparent with reference to the disclosure and figures that follow.

According to one example ("Example 1"), a fenestration unit includes a frame including a head, a first jamb, a second jamb, and a sill; a sash hinged to the frame and configured to be movable between an open position and a closed position; and an operator assembly configured to transition the sash between the open and closed positions, the operator assembly including: a drive mechanism configured to impart an opening force on the sash toward the open position and a closing force on the sash toward the closed position; a slide mechanism, the slide mechanism being slidable; and a transfer mechanism operatively coupling the slide mechanism to the drive mechanism, the transfer mechanism including: a twisted wire coupled to the slide mechanism, the twisted wire configured to rotate in response to sliding motion of the slide mechanism; a spool attached to the twisted wire, the spool configured to rotate in response to rotation of the twisted wire; and a cord coupling the spool and drive mechanism, the cord configured to transfer force to the drive mechanism and to cause the drive mechanism to impart the opening and closing forces on the sash in response to rotation of the spool.

According to another example ("Example 2"), further to the device of Example 1, the drive mechanism includes a plate coupled to the cord for reciprocal motion in response to rotation of the spool; and a linkage coupling the plate to the sash.

According to another example ("Example 3"), further to the device of Example 2, the transfer mechanism further comprises a turnaround pulley, and wherein the cord extends around the turnaround pulley and has first and second opposite end portions coupled to the plate.

According to another example ("Example 4"), further to the device of Example 3, the cord includes multiple turns around the spool.

According to another example ("Example 5"), further to the device of Example 1, the slide mechanism comprises a linear rail and a carriage configured for slidable motion along the rail and coupled to the twisted wire, wherein the motion of the carriage causes the rotation of the twisted wire.

According to another example ("Example 6"), further to the device of Example 1, the slide mechanism is associated with the frame and includes a handle that is slidable along the frame to cause the drive mechanism to impart the opening force and the closing force, respectively, on the sash.

According to another example ("Example 7"), further to the device of Example 1, the slide mechanism is slidable along a first axis resulting in an actuation force on the drive mechanism to impart the opening force and the closing force, respectively, on the sash, wherein the resultant actuation force is along a second axis that is at a non-zero angle to the first axis.

According to another example ("Example 8"), further to the device of Example 7, the first and second axes are generally perpendicular.

According to one example ("Example 9"), a fenestration unit includes a frame including a head, a first jamb, a second jamb, and a sill; a sash hinged to the frame and configured to be movable between an open position and a closed position; and an operator assembly configured to transition the sash between the open and closed positions, the operator assembly including: a drive mechanism configured as a dual rotary drive gearbox, including: a base; a worm rotatably mounted to the base; first and second worm gears rotatably mounted to the base on opposite sides of the worm and configured for rotation by the worm; first and second linkages coupling the first and second worm gears, respectively, to the sash; and a slide mechanism operatively coupled to the worm of the rotary drive gearbox, the slide mechanism being slidable to cause the drive mechanism to impart an opening force on the sash toward the open position and a closing force on the sash toward the closed position.

According to another example ("Example 10"), further to the device of Example 9, the operator assembly further comprises a transfer mechanism including a drive belt operatively coupling the slide mechanism to the drive mechanism.

According to another example ("Example 11"), further to the device of Example 9, the drive mechanism further comprises a pully mounted to the worm.

According to one example ("Example 12"), a dual rotary drive gearbox of the type for use with a fenestration unit, includes a base; a worm rotatably mounted to the base; and first and second worm gears rotatably mounted to the base on opposite sides of the worm and configured for rotation by the worm.

According to another example ("Example 13"), further to the device of Example 12, the gear box further comprising first and second linkages extending from the first and second worm gears, respectively, and configured to be coupled to a sash.

According to one example ("Example 14"), a fenestration unit includes a frame including a head, a first jamb, a second jamb, and a sill; a sash hinged to the frame and configured to be movable between an open position and a closed position; an operator assembly configured to transition the sash between the open and closed positions, the operator assembly including: a rotary drive gearbox, including: a base; a worm rotatably mounted to the base; a worm gear rotatably mounted to the base and configured for rotation by the worm about a range of rotation defined by a first end position of 0° and a second end position of at least 170°; and an arm mounted to the worm gear, coupled to the sash, and configured for rotation in response to rotation of the worm gear about one or both of a first portion of the angular range of rotation and a second portion of the angular range of rotation, wherein the first portion is a range extending between a first portion first end position that is greater than or equal to the first end position and a first portion second end position that is less than or equal to the second end position, and the second portion is a range extending between a second portion first end position that is less than or equal to the second end position and a second portion second end position that is greater than or equal to the first end position; and a slide mechanism operatively coupled to the worm of the rotary drive gearbox, the slide mechanism being slidable to cause the rotary drive gearbox to impart an opening force on the sash toward the open position and a closing force on the sash toward the closed position.

According to another example ("Example 15"), further to the device of Example 14, the sash is hinged to a right side of the frame; and the rotary drive gearbox is configured to transition the sash between the open and closed positions in response to rotation of the arm about the first portion of the angular range.

According to another example ("Example 16"), further to the device of Example 14, the sash is hinged to a left side of the frame; and the rotary drive gearbox is configured to transition the sash between the open and closed positions in response to rotation of the arm about the second portion of the angular range.

According to another example ("Example 17"), further to the device of Example 14, a plurality of fenestration units of the type described in Example 14, including: a right side fenestration unit wherein: the sash is hinged to a right side of the frame; and the rotary drive gearbox is configured to transition the sash between the open and closed positions in response to rotation of the arm about the first portion of the angular range; and a left side fenestration unit wherein: the sash is hinged to a left side of the frame; and the rotary drive gearbox is configured to transition the sash between the open and closed positions in response to rotation of the arm about the second portion of the angular range.

According to another example ("Example 18"), further to the device of Example 17, the first portion of the angular range of the right side fenestration unit does not overlap with the second portion of the angular range of the left side fenestration unit.

According to another example ("Example 19"), further to the device of Example 17, the first portion of the angular range of the right side fenestration unit overlaps with the second portion of the angular range of the left side fenestration unit.

According to another example ("Example 20"), further to the device of Example 14, the operator assembly further comprises a transfer mechanism including a drive belt operatively coupling the slide mechanism to the drive mechanism.

According to another example ("Example 21"), further to the device of Example 14, the slide mechanism is slidable along a first axis resulting in an actuation force on the rotary drive gearbox to impart the opening force and the closing force, respectively, on the sash, wherein the resultant actuation force is along a second axis that is at a non-zero angle to the first axis.

According to another example ("Example 22"), further to the device of Example 14, the first and second axes are generally perpendicular.

According to another example ("Example 23"), further to the device of Example 14, the first and second portions of the angular range of rotation include overlapping portions.

According to another example ("Example 24"), further to the device of Example 14, the first and second portions of the angular range of rotation do not include overlapping portions.

According to one example ("Example 25"), a base for a fenestration unit rotary drive gearbox configurable as either a single arm gearbox or a dual arm gearbox, includes a base portion configured for mounting to a fenestration unit frame; a worm mount on the base configured to rotatably receive a worm; a first gear mount on the base on a first side of the worm mount, wherein the first gear mount is configured to receive a first worm gear coupled to the worm for rotation by the worm; and a second gear mount on the base on a second side of the worm mount opposite the worm mount from the first gear mount, wherein the second gear mount is configured to receive a second worm gear coupled to the worm for rotation by the worm.

According to another example ("Example 26"), further to the device of Example 25, the base is configured as a single arm gearbox, wherein the base further comprises: a worm mounted for rotation within the worm mount; and a first gear rotatably mounted to the first gear mount and coupled to the worm for rotation by the worm, wherein the second gear mount does not have a gear mounted thereto.

According to another example ("Example 27"), further to the device of Example 25, the base is configured as a dual arm gearbox, wherein the base further comprises: a worm mounted for rotation within the worm mount; and a first gear rotatably mounted to the first gear mount and coupled to the worm for rotation by the worm; and a second gear rotatably mounted to the second gear mount and coupled to the worm for rotation by the worm.

According to another example ("Example 28"), further to the device of Example 25, the worm mount comprises a tubular shell including an end opening to receive the worm and first and second side openings configured to allow engagement of the worm with the first and second gears.

According to another example ("Example 29"), further to the device of Example 25, the worm mount comprises a housing.

According to one example ("Example 30"), a fenestration unit includes a rectangular frame including a first side, a second side opposite the first side, a third side, and fourth side opposite the third side, wherein the third and fourth sides are perpendicular to the first and second sides; a sash hinged to the first side of the frame and configured to be movable between an open position and a closed position; a lock assembly including a handle on the second side of the frame; an operator assembly configured to transition the sash between the open and closed positions, the operator assembly including: a drive mechanism on the third side of the frame, the drive mechanism configured to impart an opening force on the sash toward the open position and a closing force on the sash toward the closed position; a slide mechanism on the second side of the frame operatively coupled to the drive mechanism, the slide mechanism being slidable to cause the drive mechanism to impart the opening force and the closing force on the sash; and a transfer mechanism operatively coupling the slide mechanism to the drive mechanism, the transfer mechanism including a linkage member extending over the lock assembly on a side of the lock assembly opposite the second side of the frame.

According to another example ("Example 31"), further to the device of Example 30, the linkage member of the transfer mechanism includes a drive belt operatively coupling the slide mechanism to the drive mechanism.

According to another example ("Example 32"), further to the device of Example 31, the slide mechanism comprises: a linear rail on the second side of the frame, between at least portions of the lock assembly and the fourth side of the frame; and a carriage configured for slidable motion along the rail and coupled to the drive belt, wherein the motion of the carriage causes motion of the drive belt.

According to another example ("Example 33"), further to the device of Example 32, the transfer mechanism further comprises a plurality of pulleys to support the drive belt about first and second travel paths extending along the second side of the frame, wherein the first travel path is opposite the second travel path from the second side of the frame, and wherein the plurality of pulleys includes one or more jump pulleys to support lock sections of the first and second travel paths on the side of the lock assembly.

According to another example ("Example 34"), further to the device of Example 33, the plurality of pulleys further includes a first end pulley located between the lock assembly and the fourth side of the frame, wherein the drive belt extends around the first end pulley to define first end portions of the first and second travel paths; and the one or more jump pulleys includes: a first jump pulley between the lock assembly and the first end pulley, to support the drive belt about a rail section of the second travel path, wherein the rail section of the second travel path is between the lock assembly and the first end pulley; a second jump pulley between the first jump pulley and the lock assembly, to support the drive belt about a transition section of the second travel path, wherein the transition section of the second travel path is between the rail section and the lock section of the second travel path; and a third jump pulley opposite the lock assembly from the second jump pulley, wherein the second and third jump pulleys support the drive belt about the lock section of the second travel path.

According to another example ("Example 35"), further to the device of Example 34, the plurality of pulleys further includes: a first second end pulley opposite the third jump pulley from the lock assembly, to support the drive belt about a second end portion of the first travel path; and a second end pulley opposite the third jump pulley from the lock assembly, to support the drive belt about a second end portion of the second travel path.

According to another example ("Example 36"), further to the device of Example 35, the first end pulley, the first, second and third jump pulleys, and the first and second end pulleys are configured to locate the first end portions of the first and second travel paths parallel to one other and spaced apart from one another by a first distance, and to locate the lock and second end portions of the first and second travel paths parallel to one another and spaced apart from one another by a second distance that is less than the first distance.

According to one example ("Example 37"), a fenestration unit includes a frame including a head, a first jamb, a second jamb, and a sill; a sash hinged to the frame and configured to be movable between an open position and a closed position; an operator assembly configured to transition the sash between the open and closed positions, the operator assembly including: a slide mechanism, the slide mechanism being slidable; a transfer mechanism operatively coupled to the slide mechanism and including a twisted wire on the sill configured to rotate in response to sliding motion of the slide mechanism; and a drive mechanism operatively coupled to the transfer mechanism and configured to impart an opening force on the sash toward the open position and a closing force on the sash toward the closed position, the drive mechanism including: a carriage attached to the twisted wire, wherein the carriage is configured to move along a length of the twisted wire in response to the rotation of the twisted wire; and a linkage assembly coupling the carriage to the sash.

According to another example ("Example 38"), further to the device of Example 37, the twisted wire is mounted to the sill of the frame for rotation about a first axis; and the slide mechanism is slidable along a second axis that is at a non-zero angle to the first axis.

According to another example ("Example 39"), further to the device of Example 38, the transfer mechanism comprises a drive belt operatively coupling the slide mechanism to the twisted wire.

According to another example ("Example 40"), further to the device of Example 39, the drive belt extends along a portion of the frame associated with the slide mechanism.

According to another example ("Example 41"), further to the device of Example 40, the transfer mechanism further includes a pulley on the twisted wire, wherein the pulley is operatively coupled to the drive belt to cause the rotation of the twisted wire in response to the sliding motion of the slide mechanism.

According to another example ("Example 42"), further to the device of Example 41, the first and second axes are perpendicular.

According to another example ("Example 43"), further to the device of Example 37, the linkage assembly of the drive mechanism includes a sprague brake.

According to another example ("Example 44"), further to the device of Example 37, the linkage assembly of the drive mechanism includes a dual direction sprague brake.

According to one example ("Example 45"), a fenestration unit includes a frame including a head, a first jamb, a second jamb and a sill; a sash hinged to the frame such that the sash is movable between an open position and a closed position; and an operator assembly configured to transition the sash between the open and closed positions, the operator assembly including: a drive mechanism configured as a multistage spur gearbox with no worm and no worm gear, including: a drive pulley rotatable about a drive axis; an output spur gear rotatable about an output axis; one or more spur gear reduction stages, each including at least one spur gear rotatable about a reduction stage axis, coupling the drive pulley to the output spur gear, wherein the one or more spur gear reduction stages result in an N:1 rotation ratio between the drive pulley and the output spur gear where N is greater than one; a linkage coupling the output spur gear to the sash; and a slide mechanism operatively coupled to the drive pulley of the multistage spur gearbox, the slide mechanism being slidable to cause the drive mechanism to impart an opening force on the sash toward the open position and a closing force on the sash toward the closed position.

According to another example ("Example 46"), further to the device of Example 45, the operator assembly further comprises a transfer mechanism including a drive belt operatively coupling the slide mechanism to the drive pulley of the multistage spur gearbox.

According to another example ("Example 47"), further to the device of Example 46, the slide mechanism is slidable along a first axis resulting in an actuation force on the drive mechanism to impart the opening force and the closing force on the sash, wherein the resultant actuation force is along a second axis that is at a non-zero angle to the first axis.

According to another example ("Example 48"), further to the device of Example 47, the frame defines a depth dimension; the transfer mechanism includes a plurality of pulleys to support the drive belt about first and second travel paths extending along the first and second axes, and the first and second travel paths are spaced from one another about the depth dimension.

According to another example ("Example 49"), further to the device of Example 48, the plurality of pulleys includes: an end pulley, wherein drive belt extends around the end pulley to define slide portions of the first and second travel paths associated with the slide mechanism; and a corner pulley, wherein the drive belt extends around the corner pulley to define actuator portions of the first and second travel paths associated with the drive mechanism, and that extend from the slide portions to the drive mechanism.

According to another example ("Example 50"), further to the device of Example 49, the end pulley is configured for rotation about an axis perpendicular to the depth dimension; and the corner pulley is configured for rotation about an axis perpendicular to the axis of rotation of the end pulley and parallel to the depth dimension.

According to another example ("Example 51"), further to the device of Example 50, the drive belt is defined by a thickness and a major surface having a width that is greater than the thickness, and wherein the major surface of the drive belt engages the end pulley and the corner pulley, causing the belt to rotate ninety degrees between the end pulley and the corner pulley.

According to another example ("Example 52"), further to the device of Example 51, the drive pulley of the multistage spur gearbox is configured for rotation about an axis perpendicular to the depth dimension, causing the belt to rotate ninety degrees between the corner pulley and the drive mechanism.

According to another example ("Example 53"), further to the device of Example 52, the first and second axes are perpendicular to one another.

According to another example ("Example 54"), further to the device of Example 45, the drive pulley of the multistage spur gearbox includes a spur gear operatively coupled to one of the one or more spur gear reduction stages.

According to another example ("Example 55"), further to the device of Example 54, each of the one or more spur gear reduction stages includes two spur gears.

According to another example ("Example 56"), further to the device of Example 55, at least some of the one or more spur gear reduction stages include a pinion.

According to another example ("Example 57"), further to the device of Example 56, the multistage spur gearbox includes three spur gear reduction stages.

According to another example ("Example 58"), further to the device of Example 57, the multistage spur gearbox includes three spur gear reduction stages.

According to another example ("Example 59"), further to the device of Example 45, N is greater than ten.

According to another example ("Example 60"), further to the device of Example 45, N is greater than fifteen.

According to another example ("Example 61"), further to the device of Example 45, N is greater than or equal to twenty.

According to one example ("Example 62"), a fenestration unit includes a frame defining a depth dimension and including a head, a first jamb, a second jamb and a sill; a sash hinged to the frame such that the sash is movable between an open position and a closed position; and an operator assembly configured to transition the sash between the open and closed positions, the operator assembly including: a drive mechanism including a drive pulley configured to impart an opening force on the sash toward the open position and a closing force on the sash toward the closed position, wherein the drive mechanism is associated with a first axis; a slide mechanism, wherein the slide mechanism is slidable and associated with a second axis that is a non-zero angle with respect to the first axis; and a transfer mechanism operatively coupling the slide mechanism to the drive pulley of the drive mechanism, the transfer mechanism comprising a plurality of pulleys to support the drive belt about first and second travel paths extending along the first and second axes, wherein the first and second travel paths are spaced from one another about the depth dimension.

According to another example ("Example 63"), further to the device of Example 62, the plurality of pulleys of the transfer mechanism includes: an end pulley, wherein drive belt extends around the end pulley to define slide portions of the first and second travel paths associated with the slide mechanism; and a corner pulley, wherein the drive belt extends around the corner pulley to define actuator portions of the first and second travel paths associated with the drive mechanism, and that extend from the slide portions to the drive mechanism.

According to another example ("Example 64"), further to the device of Example 63, the end pulley is configured for rotation about an axis perpendicular to the depth dimension; and the corner pulley is configured for rotation about an axis perpendicular to the axis of rotation of the end pulley and parallel to the depth dimension.

According to another example ("Example 65"), further to the device of Example 64, the drive belt is defined by a thickness and a major surface having a width that is greater than the thickness, and wherein the major surface of the drive belt engages the end pulley and the corner pulley, causing the belt to rotate ninety degrees between the end pulley and the corner pulley.

According to another example ("Example 66"), further to the device of Example 65, the drive pulley of the drive mechanism is configured for rotation about an axis perpendicular to the depth dimension, causing the belt to rotate ninety degrees between the corner pulley and the drive pulley.

According to another example ("Example 67"), further to the device of Example 66, the first and second axes are perpendicular to one another.

According to another example ("Example 68"), further to the device of Example 62, the first and second axes are perpendicular to one another.

According to one example ("Example 69"), a multistage spur gearbox for a fenestration unit, includes a drive pulley rotatable about a drive axis; an output spur gear rotatable about an output axis; and one or more spur gear reduction stages, each including at least one spur gear rotatable about a reduction stage axis, coupling the drive pulley to the output spur gear, wherein the one or more spur gear reduction stages result in an N:1 rotation ratio between the drive pulley and the output spur gear; and a linkage coupled to the output spur gear and configured to be coupled to a fenestration unit sash.

According to another example ("Example 70"), further to the device of Example 69, the drive pulley includes a spur gear operatively coupled to one of the one or more spur gear reduction stages.

According to another example ("Example 71"), further to the device of Example 70, each of the one or more spur gear reduction stages includes two spur gears.

According to another example ("Example 72"), further to the device of Example 71, at least some of the one or more spur gear reduction states include a pinion.

According to another example ("Example 73"), further to the device of Example 72, the multistage spur gearbox includes three spur gear reduction stages.

According to another example ("Example 74"), further to the device of Example 69, the multistage spur gearbox includes three spur gear reduction stages.

According to another example ("Example 75"), further to the device of Example 69, N is greater than ten.

According to another example ("Example 76"), further to the device of Example 69, N is greater than fifteen.

According to another example ("Example 77"), further to the device of Example 69, N is greater than or equal to twenty.

According to one example ("Example 78"), a fenestration unit includes a frame including a head, a first jamb, a second jamb, and a sill; a sash hinged to the frame such that the sash is movable between an open position and a closed position; and an operator assembly configured to transition the sash between the open and closed positions, the operator assembly including: a drive mechanism including a drive pulley defined by a radius and a diameter and configured for rotation about a drive axis, the drive mechanism configured to impart an opening force on the sash toward the open position and a closing force on the sash toward the closed position in response to rotation of the drive pulley; a transfer mechanism including a drive belt coupled to the drive pulley, wherein the drive belt rotates the pulley; an actuator operatively coupled to the drive belt, the actuator being operable to drive the drive belt to cause the drive mechanism to impart the opening force and the closing force on the sash; and a belt guide including: a frame portion defined by a diameter and including an aperture defining a mounting axis, wherein the mounting axis extends through the diameter and the frame portion and the frame portion is mounted to the shaft of the drive mechanism adjacent to the drive pulley with the shaft extending through and rotatable in the aperture; and first and second guide members including belt-engaging surfaces, the first and second guide members extending from the frame portion at locations spaced from the mounting axis and in a direction transverse to the diameter, wherein the first and second guide members are configured to engage outer surfaces of the drive belt and to retain the drive belt on the drive pulley during operation of the drive mechanism.

According to another example ("Example 79"), further to the device of Example 78, the belt-engaging surfaces of the first and second guide members are generally parallel to one another.

According to another example ("Example 80"), further to the device of Example 79, the belt-engaging surfaces of the first and second guide members are spaced from one another by a distance at least as great as a distance between the outer surfaces of the drive belt on the drive pulley.

According to another example ("Example 81"), further to the device of Example 80, the belt-engaging surfaces of the first and second guide members are spaced from one another by a distance greater than the distance between outer surfaces of the drive belt on the drive pulley.

According to another example ("Example 82"), further to the device of Example 78, the first and second guide members extend from the frame portion by distances at least as great as the radius of the drive pulley.

According to another example ("Example 83"), further to the device of Example 82, the first and second guide members extend from the frame portion by distances greater than the radius of the drive pulley.

According to another example ("Example 84"), further to the device of Example 78, the fenestration unit further includes first and second edge members extending from the first and second guide members, respectively, the first and second edge members configured to engage sides of the drive belt and to retain the drive belt on the drive pulley during operation of the drive mechanism.

According to another example ("Example 85"), further to the device of Example 78, the first and second guide members are configured to apply tension to the drive belt at locations spaced from the drive pulley during operation of the drive mechanism.

According to another example ("Example 86"), further to the device of Example 78, the belt-engaging surfaces of the first and second guide members are configured to allow the belt guide to rotate about the guide rotational axis and to apply a greater force to a slack side of the drive belt than a force applied to a tensioned side of the drive belt.

According to another example ("Example 87"), further to the device of Example 78, the drive belt is a toothed belt.

According to one example ("Example 88"), a belt guide configured for use on a fenestration unit of the type includes a frame including a head, a first jamb, a second jamb, and a sill; a sash hinged to the frame such that the sash is movable between an open position and a closed position; and an operator assembly configured to transition the sash between the open and closed positions, the operator assembly including: a drive mechanism including a drive pulley defined by a radius and a diameter and configured for rotation by a shaft about a drive axis, the drive mechanism configured to impart an opening force on the sash toward the open position and a closing force on the sash toward the closed position in response to the rotation of the drive pulley; a transfer mechanism including a drive belt coupled to the drive pulley, wherein the drive belt rotates the pulley; an actuator operatively coupled to the drive belt, the actuator being operable to drive the drive belt to cause the drive mechanism to impart the opening force and the closing force on the sash;

and wherein the belt guide comprises: a frame portion defined by a diameter and including an aperture defining a mounting axis, wherein the mounting axis extends through the diameter and the frame portion is configured to be mounted to the shaft of the drive mechanism adjacent to the drive pulley with the shaft extending through and rotatable in the aperture; and first and second guide members including belt-engaging surfaces, the first and second guide members extending from the frame at locations spaced from the mounting axis and in a direction transverse to the diameter, wherein the first and second guide members are configured to engage outer surfaces of the drive belt and to retain the drive belt on the drive pulley during operation of the drive mechanism.

According to another example ("Example 89"), further to the device of Example 88, the belt-engaging surfaces of the first and second guide members are generally parallel to one another.

According to another example ("Example 90"), further to the device of Example 89, the belt-engaging surfaces of the first and second guide members are spaced from one another by a distance at least as great as a distance between the outer surfaces of the drive belt on the drive pulley.

According to another example ("Example 91"), further to the device of Example 92, the belt-engaging surfaces of the first and second guide members are spaced from one another by a distance greater than the distance between outer surfaces of the drive belt on the drive pulley.

According to another example ("Example 92"), further to the device of Example 88, the first and second guide members extend from the frame portion by distances at least as great as the radius of the drive pulley.

According to another example ("Example 93"), further to the device of Example 92, the first and second guide members extend from the frame portion by distances greater than the radius of the drive pulley.

According to another example ("Example 94"), further to the device of Example 88, the belt guide further includes first and second edge members extending from the first and second guide members, respectively, the first and second edge members configured to engage sides of the drive belt and to retain the drive belt on the drive pulley during operation of the drive mechanism.

According to another example ("Example 95"), further to the device of Example 88, the first and second guide members are configured to apply tension to the drive belt at locations spaced from the drive pulley during operation of the drive mechanism.

According to another example ("Example 96"), further to the device of Example 88, the belt-engaging surfaces of the first and second guide members are configured to allow the belt guide to rotate about the guide rotational axis and to apply a greater force to a slack side of the drive belt than a force applied to a tensioned side of the drive belt.

According to one example ("Example 97"), a fenestration unit includes a frame including a head, a first jamb, a second jamb, and a sill; a sash hinged to the frame such that the sash is movable between an open position and a closed position; and an operator assembly configured to transition the sash between the open and closed positions, the operator assembly including: a transfer mechanism including a drive belt; a drive mechanism coupled to the drive belt and configured to impart an opening force on the sash toward the open position and a closing force on the sash toward the closed position in response to movement of the drive belt; and a slide mechanism operatively coupled to the drive belt, the slide mechanism being slidable to cause the movement of the drive belt, the slide mechanism including: a carriage attached to the drive belt at a first location and slidable along the frame; a brake configured to releasably couple a second location of the drive belt to the carriage, wherein in a brake position the brake engages the second location of the drive belt with the carriage, and in a release position the brake enables the drive belt to disengage from the carriage to allow the slide mechanism to slide and cause the movement of the drive belt; and an actuator operatively coupled to the brake to move the brake between the brake and release positions.

According to another example ("Example 98"), further to the device of Example 97, the transfer mechanism further includes one or more pulleys to support the drive belt and define a first loop portion including the first location of the drive belt and a second loop portion including the second location of the drive belt; the carriage includes an attachment portion between the first and second loop portions of the drive belt, wherein the attachment portion is attached to the first loop portion of the drive belt; and the actuator is configured to cause the brake to engage the second loop portion of the drive belt with the attachment portion of the carriage when the brake is in the brake position, and to enable the second loop portion of the drive belt to disengage from the attachment portion of the carriage when the brake is in the release position.

According to another example ("Example 99"), further to the device of Example 98, the actuator comprises: a shuttle operatively coupled to the carriage and the brake, wherein the shuttle is movable with respect to the carriage between an unactuated position causing the brake to be in the brake position, and an actuated position causing the brake to be in the release position; and a bias member configured to bias the shuttle to the unactuated position.

According to another example ("Example 100"), further to the device of Example 99, the shuttle includes a cam operatively coupled to the brake and configured to move the brake between the brake and release positions in response to movement of the shuttle between the unactuated and actuated positions, respectively.

According to another example ("Example 101"), further to the device of Example 100, the cam of the shuttle includes one or more slots; and the brake includes one or more pins extending into the one or more slots.

According to another example ("Example 102"), further to the device of Example 99, the fenestration unit further includes a handle on the shuttle.

According to another example ("Example 103"), further to the device of Example 99, the actuator comprises: a shuttle operatively coupled to the carriage and brake, wherein the shuttle is movable with respect to the carriage between an unactuated position causing the brake to be in the brake position, and first and second actuated positions on opposite sides of the unactuated position causing the brake to be in the release position; and one or more bias members configured to bias the shuttle to the unactuated position from the first and second actuated positions.

According to another example ("Example 104"), further to the device of Example 103, the shuttle includes a cam operatively coupled to the brake and configured to move the brake between the brake and the release positions in response to movement of the shuttle between the unactuated position and the first and second actuated positions, respectively.

According to another example ("Example 105"), further to the device of Example 104, the cam on the shuttle includes first and second slots; and the brake includes first and second pins extending into the first and second slots, respectively.

According to another example ("Example 106"), further to the device of Example 103, the fenestration unity further includes a handle on the shuttle.

BRIEF DESCRIPTION OF THE DRAWINGS

The accompanying drawings are included to provide a further understanding of the disclosure and are incorporated in and constitute a part of this specification, illustrate embodiments, and together with the description explain the principles of the disclosure.

DETAILED DESCRIPTION

Definitions and Terminology

This disclosure is not meant to be read in a restrictive manner. For example, the terminology used in the application should be read broadly in the context of the meaning those in the field would attribute such terminology.

With respect to terminology of inexactitude, the terms "about" and "approximately" may be used, interchangeably, to refer to a measurement that includes the stated measurement and that also includes any measurements that are reasonably close to the stated measurement. Measurements that are reasonably close to the stated measurement deviate from the stated measurement by a reasonably small amount as understood and readily ascertained by individuals having ordinary skill in the relevant arts. Such deviations may be attributable to measurement error or minor adjustments made to optimize performance, for example. In the event it is determined that individuals having ordinary skill in the relevant arts would not readily ascertain values for such reasonably small differences, the terms "about" and "approximately" can be understood to mean plus or minus 10% of the stated value.

Certain terminology is used herein for convenience only. For example, words such as "top", "bottom", "upper," "lower," "left," "right," "horizontal," "vertical," "upward," and "downward" merely describe the configuration shown in the figures or the orientation of a part in the installed position. Indeed, the referenced components may be oriented in any direction. Similarly, throughout this disclosure, where a process or method is shown or described, the method may be performed in any order or simultaneously, unless it is clear from the context that the method depends on certain actions being performed first.

A coordinate system is presented in the Figures and referenced in the description in which the "Y" axis corresponds to a vertical direction, the "X" axis corresponds to a horizontal or lateral direction, and the "Z" axis corresponds to the interior/exterior direction.

The section headers in the description below are not meant to be read in a limiting sense, nor are they meant to segregate the collective disclosure presented below. The disclosure should be read as a whole. The headings are simply provided to assist with review, and do not imply that discussion outside of a particular heading is inapplicable to the portion of the disclosure falling under that heading.

DESCRIPTION OF VARIOUS EMBODIMENTS

Figure 1A:
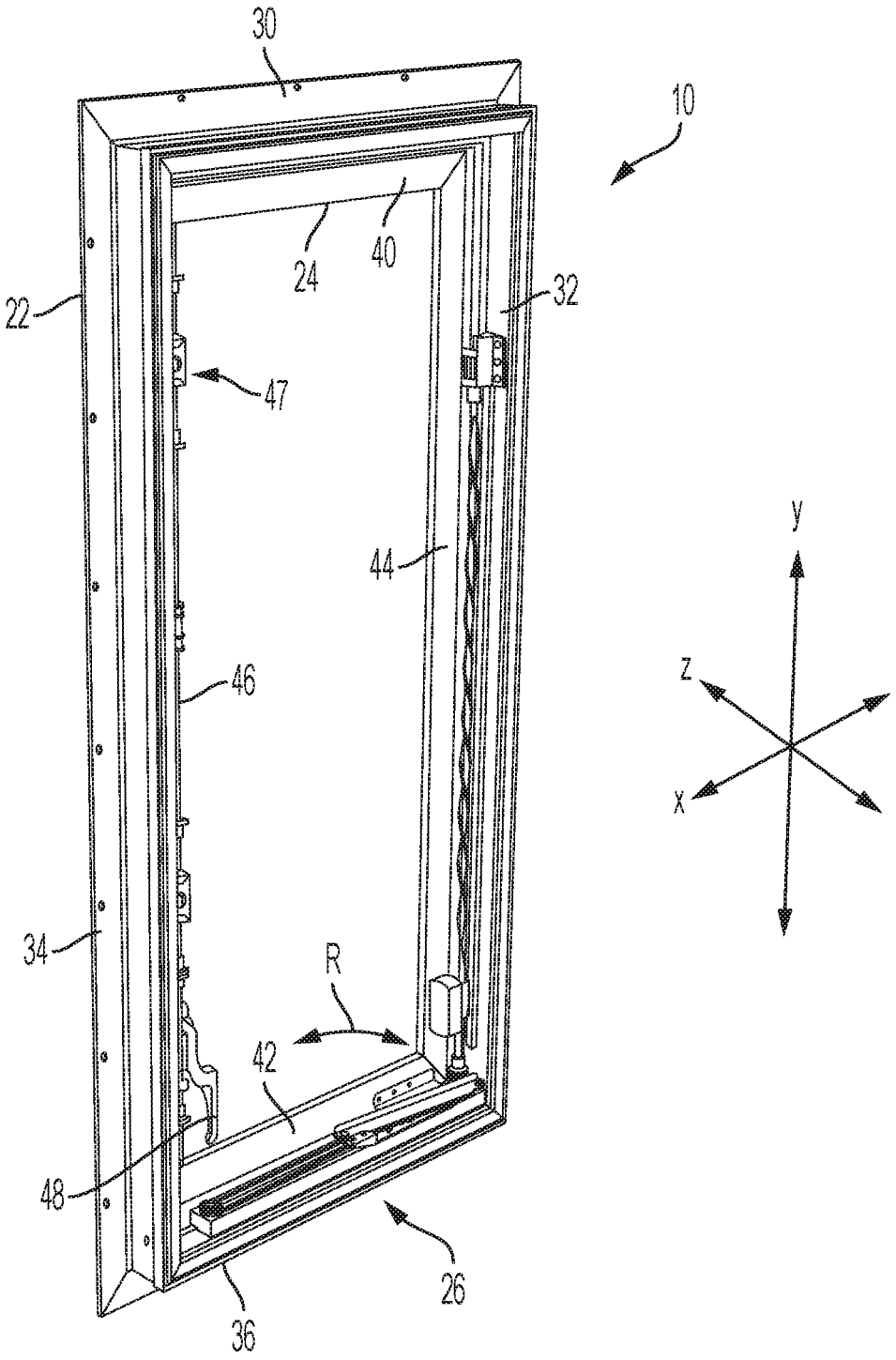
FIGS. 1A and 1B are isometric views of a casement fenestration unit, according to some examples.
Figure 1B:
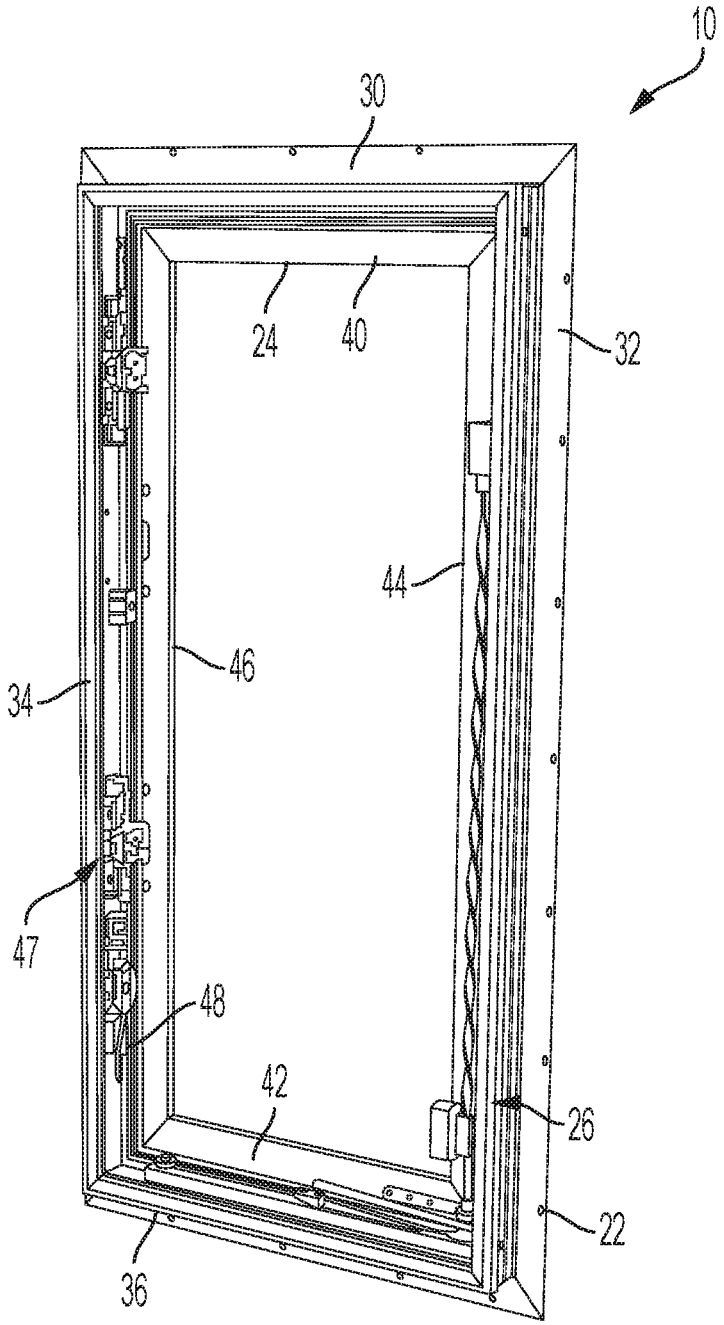

FIGS. 1A and 1B are isometric views of a fenestration unit 10 according to some examples. In terms of orientation, in the view of FIGS. 1A and 1B the fenestration unit 10 is being viewed from an interior-facing side of the unit 10. As shown, the fenestration unit 10 includes a frame 22, a sash 24 hinged to the frame 22 such that the sash 24 is pivotable or otherwise movable (e.g., through a pivoting and swinging motion) in an arcuate direction R between an open position and a closed position, and an operator assembly 26 configured to transition the sash 24 between the open and closed positions.

The frame 22 and sash 24 may be any of a variety of styles and designs, including casement-, awning-, or hopper-styles as previously described. In the example of FIGS. 1A and 1B, the frame 22 and sash 24 are configured in the casement-style arrangement. It should also be understood that the casement example of FIGS. 1A and 1B can be rotated (e.g., clockwise) by 90 degrees to present an awning window configuration. Examples of suitable window frames and sashes that may be modified for use with the operator assembly 26 include those commercially available from Pella Corporation of Pella, Iowa under the tradename "IMPERVIA," although any of a variety of designs are contemplated.

As shown, the frame 22 has a head 30, a first jamb 32, a second jamb 34, and a sill 36. The sash 24 has a top rail 40, a bottom rail 42, a first stile 44 and a second stile 46. Glazing (e.g., an IG unit) is supported by the rails and stiles. A latch assembly 47, including a handle 48, is located on a side of the frame 22, e.g., on second jamb 34 in the embodiments illustrated in FIGS. 1A and 1B. Through use of the handle 48, an operator can actuate the latch assembly 47 to lock the sash 24 in the closed position with respect to the frame 22, and to unlock the sash and enable the sash to be moved between the closed and open positions by use of the operator assembly 26. When the fenestration unit 10 is in a closed configuration, the maximum viewing area presented through the fenestration unit 10 generally corresponds to the central area defined by the rails and stiles, unless some non-transparent feature of the glazing projects inwardly of the stiles and rails. As referenced above, in some examples the configuration of the operator assembly 26 helps avoid unnecessary protrusion into, or impingement of, the viewing area or other sightlines associated with the fenestration unit 10 (e.g., as compared to traditional crank handle designs).

Figure 2:
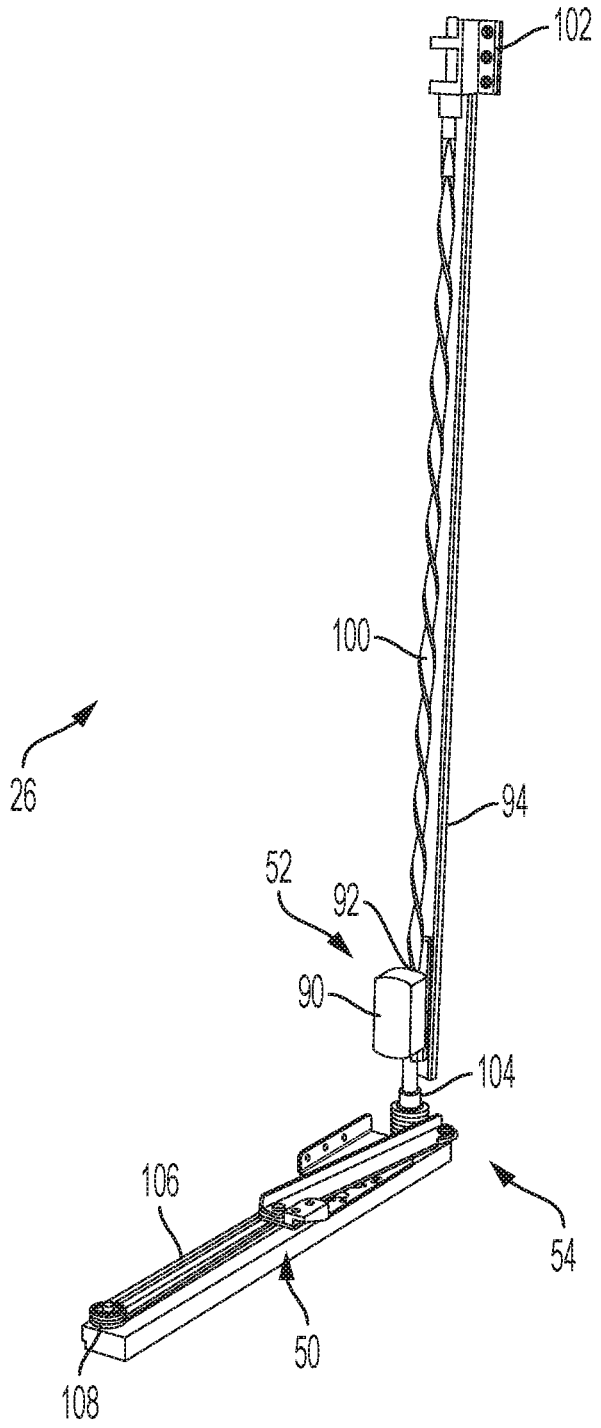
FIG. 2 is an isometric illustration of the operator assembly of the fenestration unit shown in FIGS. 1A and 1B.

FIG. 2 is an isolated, isometric view of the operator assembly 26. As shown, the operator assembly 26 includes a drive mechanism 50, a slide mechanism 52, and a transfer mechanism 54 operatively coupling the drive mechanism and slide mechanism. In general terms, the operator assembly 26 is configured to receive a first, linear input from a user of the fenestration unit 10 (FIGS. 1A, 1B) along a first axis (e.g., the Y- or vertical axis as shown in FIG. 2), which is then transferred along a second axis (e.g., the X- or horizontal axis as shown in FIG. 2) to cause the operator assembly 26 to impart an opening or closing force on the sash 24 (FIGS. 1A, 1B).

Figure 3:
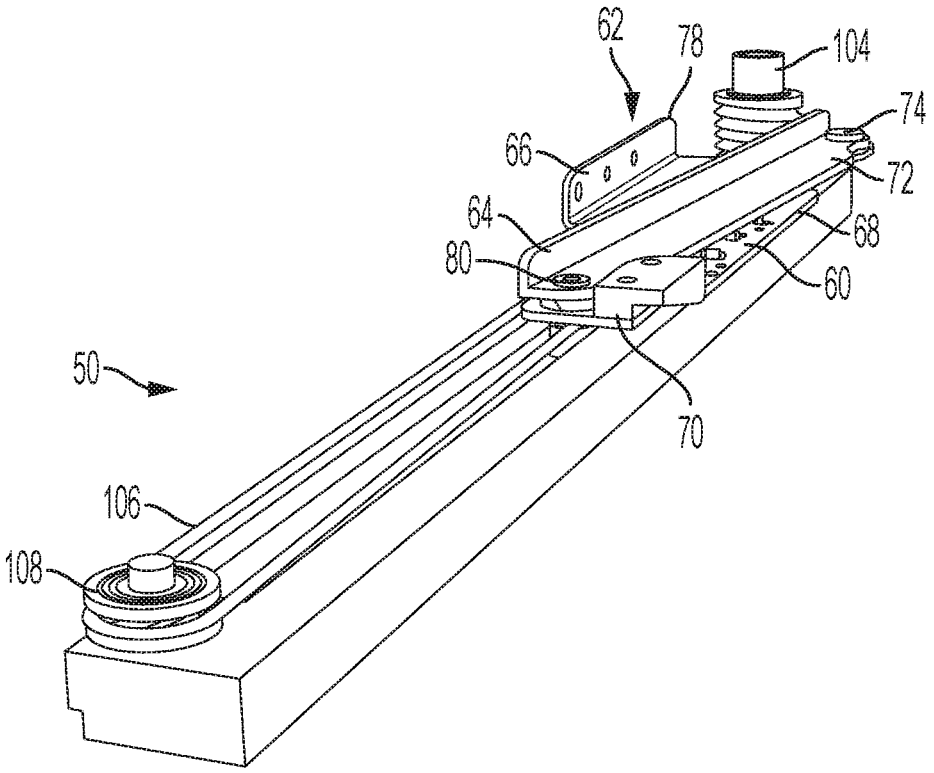
FIG. 3 is a detailed isometric illustration of components of the operator assembly shown in FIG. 2.
Figure 5:
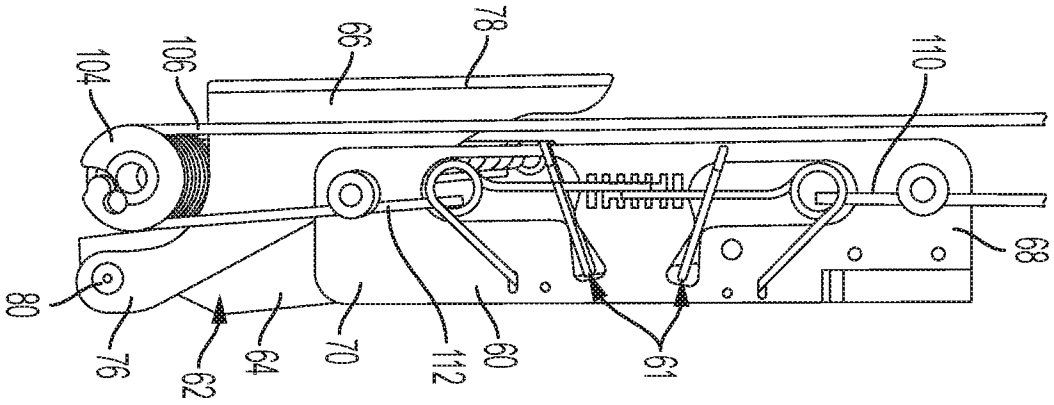
FIG. 5 is a detailed plan view of components of the operator assembly shown in FIG. 2.

The drive mechanism 50 is configured to receive an input force (e.g., linear) from the slide mechanism 52 through the transfer mechanism 54 and to translate that input force into an opening force on the sash 24 toward the open position and a closing force on the sash toward the closed position. As shown in FIGS. 3 and 5, the drive mechanism 50 includes a plate 60 that is configured for generally linear, reciprocal motion by the transfer mechanism 54, and a linkage assembly 62 including link 64 and bracket 66 coupling the plate to the sash 24, as well as sprague or sprag brakes 61. Generally, the plate 60 receives an input force (e.g., linear) from the cord 106 of the transfer mechanism 54 (described in greater detail below) which is then translated into reciprocal or back-and-forth linear motion of the plate. As shown, the plate 60 has a first end portion 68 and a second, opposite end portion 70

Link 64 has a first end portion 72 and a second, opposite end portion 74. The first end portion 72 of the link 64 is pivotally connected to the first end portion 68 of the plate 60 by pivot coupler 74. Bracket 66 has a first end portion 76 and a second, opposite end portion 78. The first end portion 76 of the bracket 66 is connected to the second end portion 70 of the plate 60 by pivot coupler 80. The second end portion 78 of the bracket 66 is configured to mounted to the sash 24. The link 64 couples the plate 60 and bracket 66 such that the linear motion of the plate results in an opening or closing swing force in the X-Z plane on the bracket. The opening or closing swing force is translated to the sash 24 by coupling the bracket 66 to the sash according to the example of FIGS. 1A and 1B.

Figure 4:
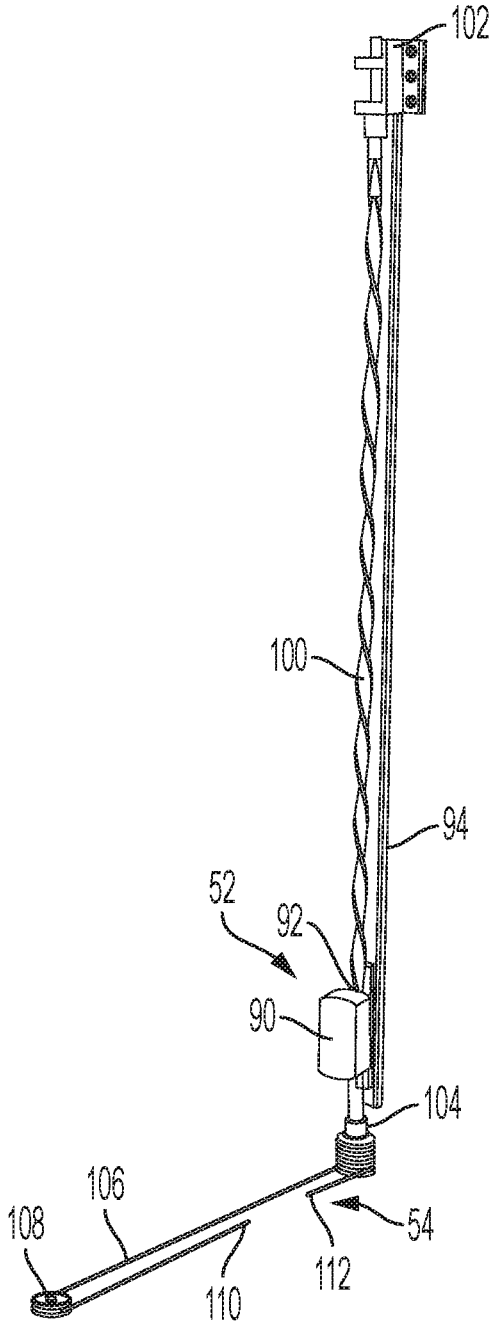
FIG. 4 is an isometric illustration of the operator assembly shown in FIG. 2, with portions removed.

FIG. 4 is an isolated isometric view of the slide mechanism 52 and the transfer mechanism 54. As shown, the slide mechanism 52 includes a handle 90, a carriage or slide member 92 coupled to the handle 90, and a linear rail 94 along which the slide member 92 is slidably received. The slide member 92 also includes an attachment structure (e.g., a channel or slot) for operatively coupling with the transfer mechanism 54. In various examples the linear rail 94 is associated with (e.g., attached to or integrally formed as part of) the frame 22, such as the first jamb 32 (FIGS. 1A, 1B). In this manner, a user is able to grasp the handle 90 of the slide mechanism 52 and slide the slide member 92 linearly (e.g. vertically) along the first jamb 32. As subsequently described, this linear motion is translated through the transfer mechanism 54 to the drive mechanism 50. As shown in FIG. 1, the handle 90 is arranged to project inwardly toward the center of the fenestration unit 10, although the handle can also be modified to project interiorly, from the interior side of the fenestration unit.

With reference to FIGS. 2-4, the transfer mechanism 54 includes twisted wire 100 that is a tape-like or band-like first drive member that is twisted to define a desired number of turns, or twists at a desired frequency. The twisted wire 100 is mounted to the first jamb 32 by a bracket 102 for rotation about the longitudinal axis of the twisted wire. The twisted wire 100 is free to rotate (e.g., about the Y-axis) and configured to convert the linear motion of the slide member 92 into rotary motion of the twisted wire 100. In embodiments, the twisted wire 100 extends through a slot or channel (not visible) in the slide member 92, such that as the slide member travels along the twisted wire, the linear motion of the slide member causes the rotation of the twisted wire.

The twisted wire 100 is optionally formed by twisting a band of material (e.g., a metallic band) to get a helical configuration. The rate, or number of twists per unit length, may be varied to achieve a desired opening/closing force and rate profile. For example, it may be desirable to begin the opening sequence relatively slowly and thus a relative low rate of turns may be desirable in the band with the number of turns, or twists increasing per unit length along the length of the band to result in a faster opening rate.

The transfer mechanism 54 also includes a transfer block in the form of a spool 104 on an end portion of the twisted wire 100, and a second drive member in the form of an elongated flexible member such as cord 106. The spool 104 is configured for rotation with the twisted wire 100 (e.g., can be mounted for rotation to the first jamb 32 and/or the sill 36). A first portion of the cord 106 extends around and engages the spool 104, and a second portion extends along the sill 36 and engages the plate 60 of the drive mechanism 52. In the illustrated embodiments, several turn lengths of the cord 106 extend around the spool 104 to provide an optimum or otherwise desired amount of motion transfer between the spool and cord. The second portion of the cord 106 is supported on the sill 36 by a turnaround pulley 108 at a location opposite the plate 60 from the spool 104. In the illustrated embodiments, the second portion of the cord 106 extends along an axis (e.g., the X-axis) that is perpendicular to the longitudinal axis of the twisted wire 100 (e.g., the Y-axis). The second portion of the cord 106 has a first length portion that extends between the spool 104 and the pulley 108, and a second length portion that is coupled to the plate 60 between the spool and the pulley. In the illustrated embodiments, opposite end portions 110, 112 of the cord 106 are coupled to the plate 60. Several turns of the cord 106 around the spool 104 are shown in the illustrated embodiments to obtain an optimum motion transfer between the spool and cord.

Rotational motion of the spool 104 when driven by rotation of the twisted wire 100 is transferred to and causes reciprocal linear motion of the second portion of the cord 106. The linear motion of the cord 106 is coupled to the plate 60 and drives the plate along its path of motion to cause the sash 24 to open and close as described above. In other embodiments (not shown), the spool 104 can include teeth or other friction-enhancing surface features to engage the cord 106, the spool can take the form of a gear or other rotating drive mechanisms, and/or the cord can take the form of a belt, cable, tape or ribbon.

Figure 6:
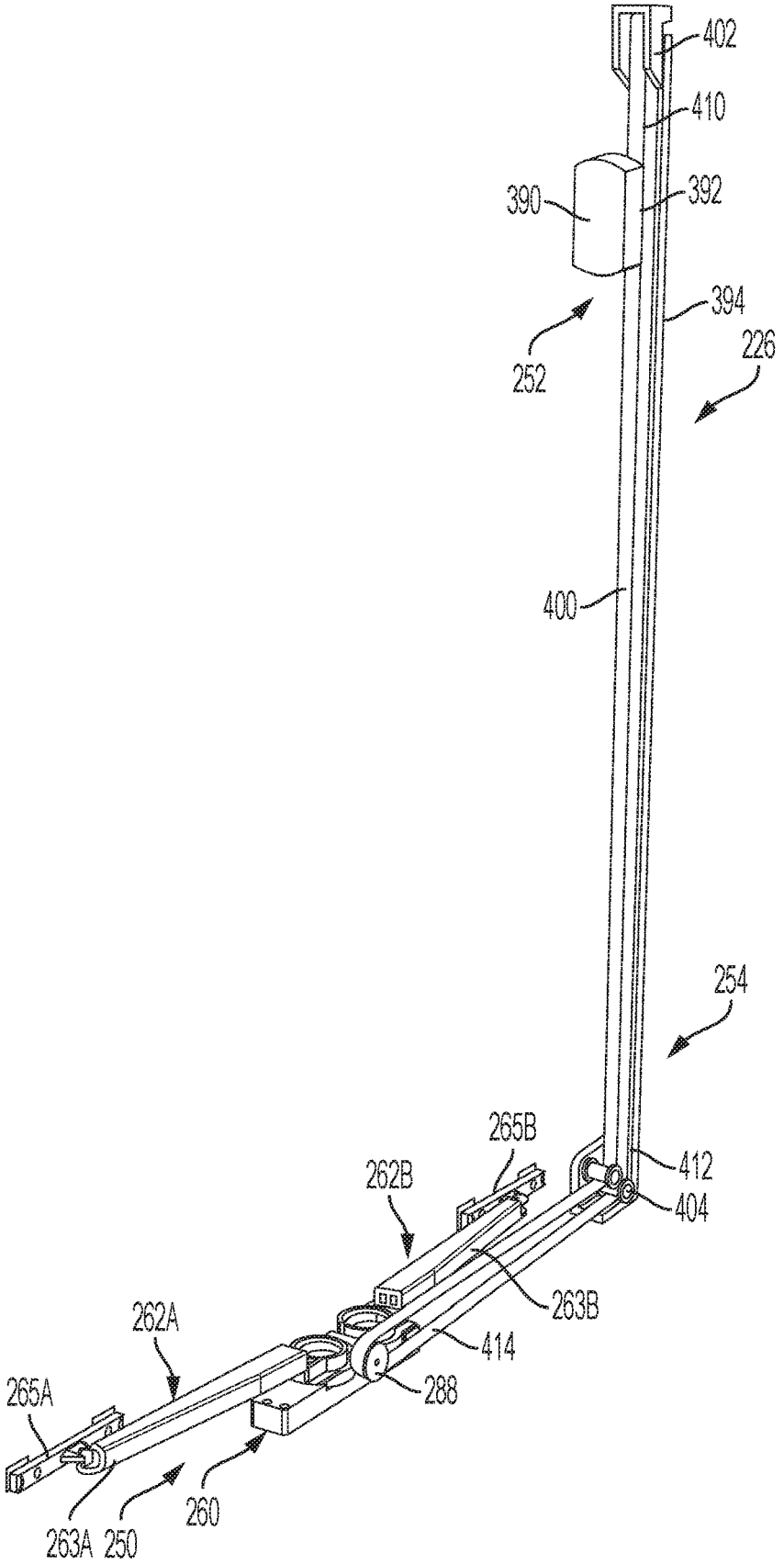
FIG. 6 is a detailed isometric illustration of an operator assembly according to additional examples.

FIG. 6 is an isolated, isometric view of an operator assembly 226 in accordance with embodiments that can be incorporated into a fenestration unit including a sash (not shown in FIG. 6) such as those described above (e.g., in connection with FIGS. 1A, 1B). As shown, the operator assembly 226 include a rotary drive mechanism 250, a slide mechanism 252, and a transfer mechanism 254 operatively coupling the slide and drive mechanisms. In general terms, the operator assembly 226 is configured to receive a first, linear input from a user of the fenestration unit along a first axis (e.g., a Y- or vertical axis), which is transferred along a second axis (e.g., an X- or horizontal axis) to cause the operator assembly 226 to impart an opening or closing force on the sash of the fenestration unit.

Figure 7:
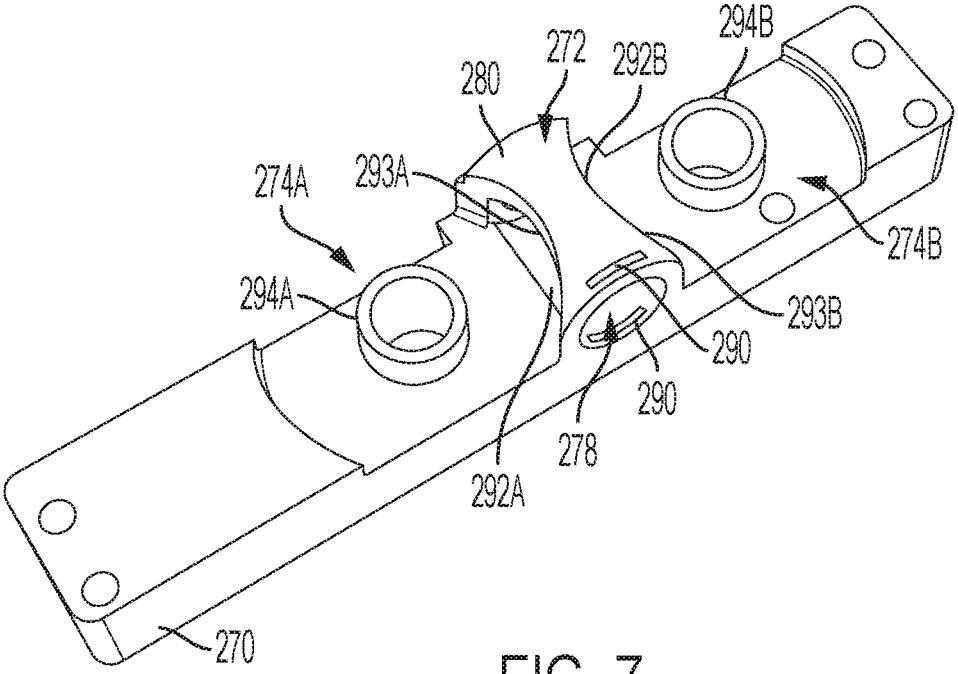
FIG. 7 is a detailed isometric illustration of the base of the rotary gearbox of the operator assembly shown in FIG. 6.
Figure 8:
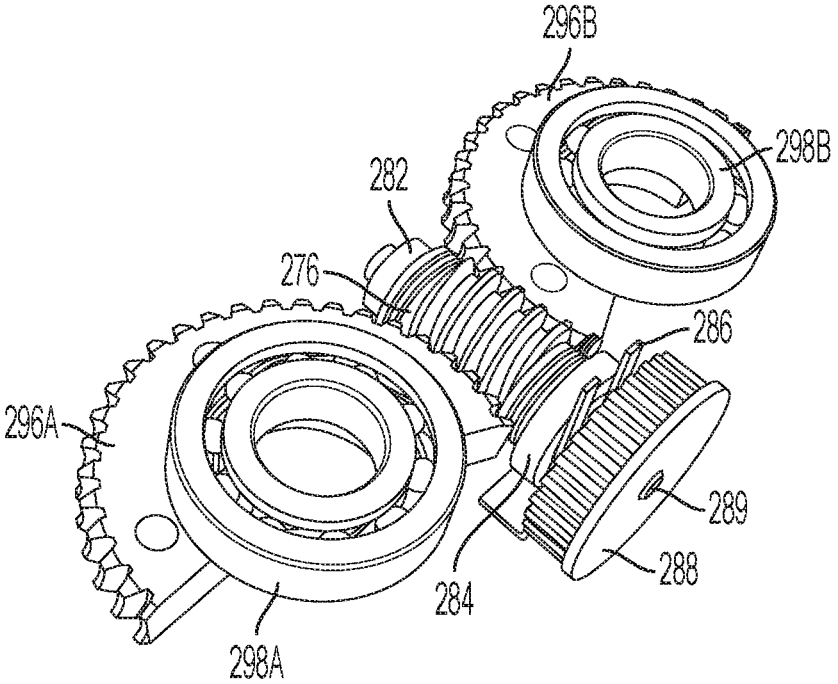
FIG. 8 is a detailed isometric illustration of the worm and worm gears that can be mounted to the base of the rotary gearbox shown in FIG. 7.

The drive mechanism 250 is configured to receive an input force (e.g., linear or rotational) from the slide mechanism 252 through the transfer mechanism 254 and to translate that input force into an opening force on the sash toward the open position and a closing force on the sash toward the closed position. As shown in FIG. 6 the drive mechanism 250 is configured as a dual arm awning device that includes a rotary gearbox 260 and first and second linkage assemblies 262A and 262B. Generally, the rotary gearbox 260 receives an input force (e.g., linear) which is then translated into rotational forces onto both linkage assemblies 262A and 262B to which the rotary gearbox is operatively coupled. FIGS. 7 and 8 are detailed isometric views of components of the rotary gearbox 260. As shown, the gearbox 260 includes a base 270, a worm housing 272 on the base, and first and second gear mounts 274A and 274B, respectively, on the base on opposite sides of the worm housing. Base 270 is configured to be mounted to the frame (e.g., on the sill) of the fenestration unit. The worm housing 272 is configured to support a worm 276 for rotation on the base 270, and in the illustrated embodiments is a generally tubular shell having a first end opening 278 configured to receive the worm, and a second end 280 configured to rotatably support a second end 282 of the worm. A bushing 284 can be attached to a first end of the worm and fit into the opening 278 to rotatably support the first end of the worm in the housing 272. A clip 286 can be inserted into slots 290 that extend through the base 270 and open into the worm housing 272 to retain the worm 276 in the housing. A drive pulley 288 is attached to the drive shaft 289 extending from the first end of the worm 276, to enable the worm to be driven by the transfer mechanism 254 as described below. First and second side openings 292A and 292B through opposite side walls 293A and 293B of the worm housing 272 between the first end opening 278 and the second end 280 face the first and second gear mounts 274A and 274B, respectively. As described below, the first and second side openings 292A and 292B, respectively, provide access to the worm 276. In the illustrated embodiments the side walls 293A and 293B of the worm housing 272 are generally concave to expose the worm 276.

The first and second gear mounts 274A and 274B include rims 294A and 294B that extend from the base 270 and are configured to support worm gears 296A and 296B, respectively, for rotation by the worm 276. In the illustrated embodiments, the worm gears 296A and 296B are mounted to the rims 294A and 294B by bearings 298A and 298B, respectively. The rims 294A and 294B are located on the base 270, and the bearings 298A and 298B and worm gears 296A and 296B are configured, so as to cause the teeth of the worm gears to engage the teeth of worm 276 through the first and second side openings 292A and 292B, respectively. Both worm gears 296A and 296B are thereby driven or rotated simultaneously by rotation of the worm 276. In the illustrated embodiments, the base 270, including the worm housing 272 and rims 294A and 294B, is configured as a one-piece metal, plastic or other material member that can, for example, be molded, cast or otherwise formed using conventional or otherwise known manufacturing methods.

As shown, the drive pulley 288 may be configured with teeth or other surface features that assist with receiving an input force. The drive pulley 288 is configured to rotate (e.g., about the Z-axis) and is operatively coupled to the worm 276 through the drive shaft 289 to rotate the worm. The worm 288 is a gear in the form of a screw with helical threading, and as discussed above is configured to engage with and rotate the worm gears 296A and 296B (e.g., about the Y-axis). Thus, the worm gears 296A and 296B, which are similar to spur gears, are rotatable via an input force on the drive pulley 288 causing the drive pulley to rotate.

As shown in FIG. 6, the linkage assemblies 262A and 262B include arms 263A and 263B, and sash braces 265A and 265B, respectively. The arms 263A and 263B are coupled to the worm gears 296A and 296B (e.g., directly or indirectly by being mounted to the bearings 298A and 298B) such that the rotation of the worm gears imparts rotational forces on the arms, respectively. The sash braces 265A and 265B are pivotally connected to the arms 263A and 263B, respectively, such that the rotational forces on the arms result in an opening or closing swing force in the Y-Z plane on the sash braces. The opening or closing swing force is translated to the sash 24 (e.g., FIGS. 1A, 1B) by coupling the sash braces 265A and 265B to the sash (e.g., at the bottom rail 42 shown in FIGS. 1A, 1B).

Slide mechanism 252 and transfer mechanism 254 can be described with reference to FIG. 6. As shown, the slide mechanism 252 includes a handle 390, a slide member 392 coupled to the handle 390, and a linear rail 394 along which the slide member is slidably received. The slide member 392 also includes an attachment mechanism (e.g., ribbed teeth) for operatively coupling with the transfer mechanism 254. In various examples the linear rail 394 is associated with (e.g., attached to or integrally formed as part of) the sash frame (e.g., the first jamb 32 of the frame 22 shown in FIGS. 1A, 1B). In this manner, a user is able to grasp the handle 390 on the slide mechanism 352 and slide the slide member 392 linearly (e.g., vertically, along the first jamb). As subsequently described, this linear motion is translated through the transfer mechanism 254 to the drive mechanism 250. The handle 390 is arranged to project inwardly toward the center of the fenestration unit (e.g., unit 10 shown in FIGS. 1A, 1B), although the handle can also be modified to project interiorly, from the interior side of the fenestration unit.

The transfer mechanism 254 is shown to include a drive belt 400, a first transfer block 402 and a second transfer block 404. The drive belt 400 is generally a ribbed or toothed belt that is flexible and resilient. The first transfer block 402 include a pulley system that the drive belt 400 is able to travel around and reverse direction. In embodiments, the first transfer block 402 is located along a first jamb of a fenestration unit, toward the head (e.g., jamb 32 and head 30 of fenestration unit 10 shown in FIGS. 1A, 1B). The second transfer block 404 includes a pulley system (e.g., a dual pulley system) and is configured to redirect the drive belt 400 direction of travel from a generally horizontal path, axis or direction to a generally vertical path, axis or direction. In embodiments, the second transfer block 404 is located toward a corner of the fenestration unit (e.g., toward an intersection of the first jamb 32 and the sill 36 of the fenestration unit 10 shown in FIGS. 1A, 1B).

The drive belt 400 has a first portion 410 looped around the first transfer block 402, an intermediate portion 412 looped past the second transfer block 404, and a second portion 414 looped around the drive pulley 288. The ends of the drive belt 400 are secured to the slide member 392. In this manner, the drive belt 400 extends along two sides of the fenestration unit frame in a continuous loop (e.g., along the first jamb 32 and then along the sill 36 of the fenestration unit 10 shown in FIGS. 1A, 1B). The drive belt 400 is coupled to the slide member 392 by an attachment mechanism (e.g., ribbed teeth). In operation, the handle 390 is slid along a first axis (e.g., upwardly or downwardly along the Y-axis), resulting in the drive belt 400 being driven along the Y-axis and then along the X-axis through a generally perpendicular path, which then results in turning of the drive pulley 288. As previously described, actuation of the drive pulley 288 (e.g., by imparting an actuation force through the drive belt 400) causes the drive mechanism 250 to open and close the sash (e.g., sash 24 of fenestration unit 10 shown in FIGS. 1A, 1B). In other words, the slide mechanism 252 is operatively coupled to the drive mechanism 250 via the transfer mechanism 254, the slide mechanism being slidable to cause the drive mechanism to impart the opening force and the closing force, respectively, on the sash.

Figure 9:
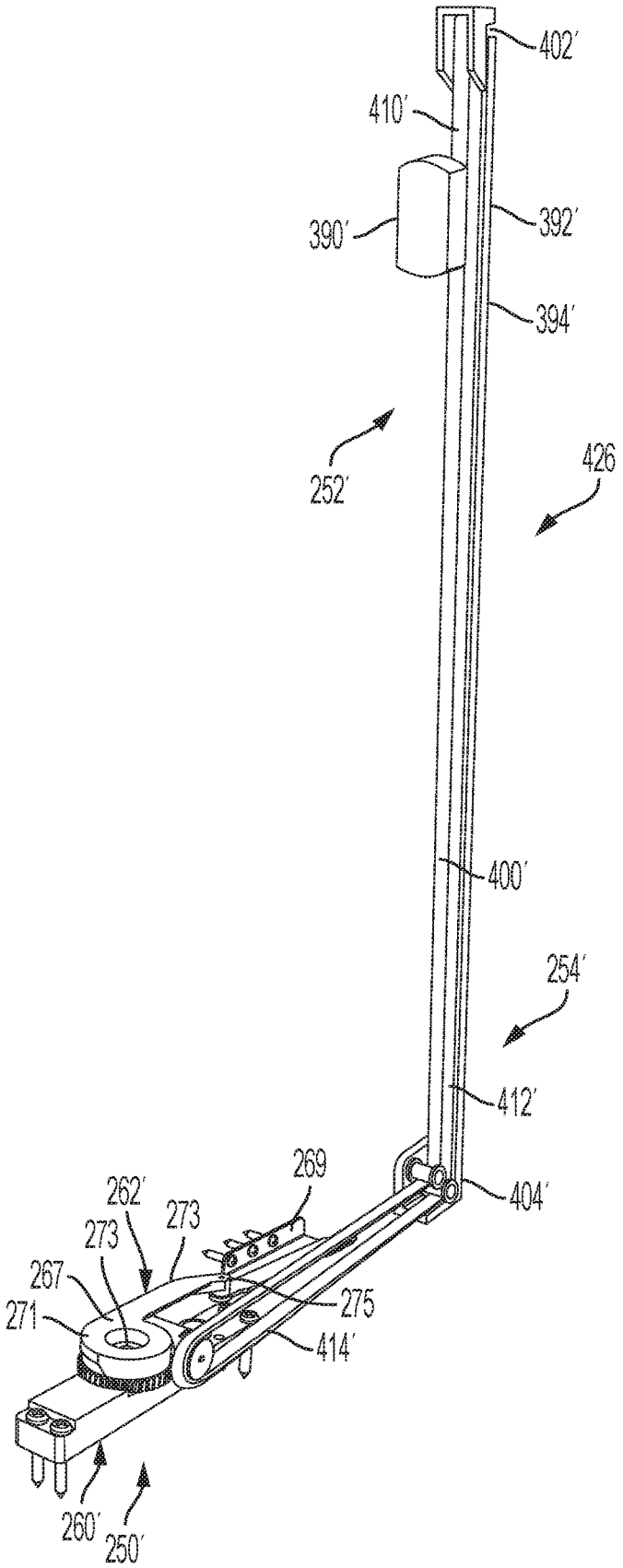
FIG. 9 is a detailed isometric illustration of an operator assembly according to additional examples.

FIG. 9 is an isolated, isometric view of an operator assembly 426 in accordance with embodiments that can be incorporated into a fenestration unit including a sash (not shown in FIG. 9) such as those described above (e.g., in connection with FIGS. 1A, 1B). As shown, the operator assembly 426 includes a rotary drive mechanism 250', a slide mechanism 252', and a transfer mechanism 254'. Generally, the operator assembly 426 can operate similarly to and includes similar components as the operator assembly 226 described above in connection with FIG. 6, with some different features described below. The slide mechanism 252' and the transfer mechanism 254' can be the same as or similar to slide mechanism 252 and transfer mechanism 254, respectively, described above in connection with FIGS. 6-8, and similar reference numbers are used to identify similar features. The slide mechanism 252' and transfer mechanism 254' also can function in the same or similar manner to slide mechanism 252 and transfer mechanism 254, respectively, described above.

The features of rotary drive mechanism 250' are largely the same as features of the rotary drive mechanism 250 described above, with the exception that the drive mechanism is configured as a single arm, dual operating range rotary gearbox. Briefly, and as described in greater detail below, the rotary drive mechanism 252' has a single worm gear 296' and a single linkage assembly 262' that are configured to enable the rotary drive mechanism to drive the arm over an angular range of rotation of at least 270°. Because of this capability, the rotary drive mechanism 252' can be used in fenestration units having sashes (such unit 10 and sash 24 shown in FIGS. 1A and 1B) that are hinged on either a first or right side of the frame (e.g., frame 22 in FIGS. 1A and 1B), or a second or left side or the frame. Similar reference numbers are used to identify features of the rotary drive mechanism 250' that are the same as or similar to those of rotary drive mechanism 250 described above.

Figure 10:
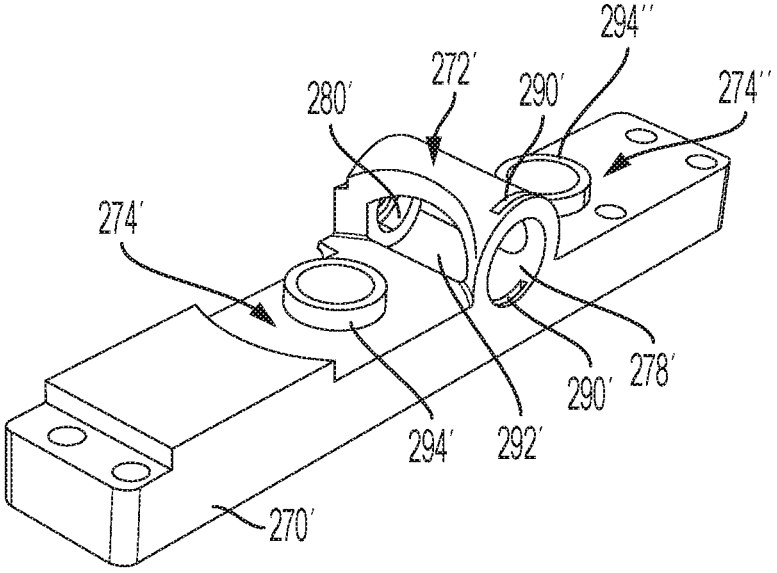
FIG. 10 is a detailed isometric illustration of the base of the rotary gearbox of the operator assembly shown in FIG. 9.
Figure 11:
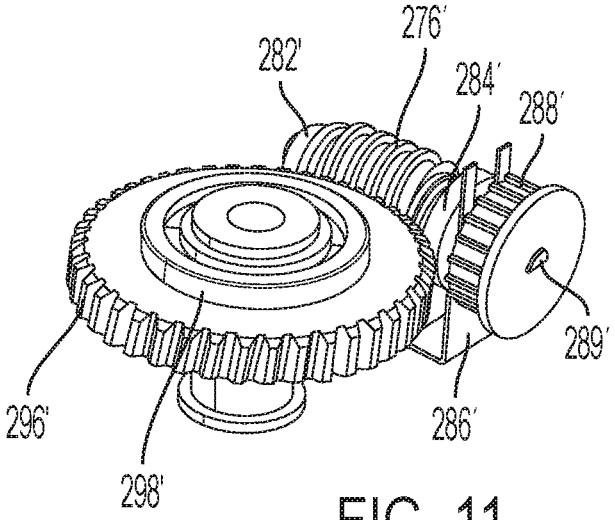
FIG. 11 is a detailed isometric illustration of the worm and worm gear that can be mounted to the base of the rotary gearbox shown in FIG. 10.

As shown in FIG. 9, the rotary drive mechanism 250' includes a rotary gearbox 260' that receives an input force (e.g., linear) which is then translated into rotational forces onto the linkage assembly 262' to which the rotary gearbox is operatively coupled. FIGS. 10 and 11 are detailed isometric views of components of the rotary gearbox 260'. As shown, the gearbox 260' includes a base 270', a worm housing 272' on the base, and a gear mount 274' on the base on a side of the worm housing. Base 270' is configured to be mounted to the frame (e.g., on the sill) of the fenestration unit. The worm housing 272' is configured to support a worm 276' for rotation on the base 270', and in the illustrated embodiments is a generally tubular shell having a first end opening 278' configured to receive the worm, and a second end 280' configured to rotatably support a second end 282' of the worm. A bushing 284' can be attached to a first end of the worm and fit into the opening 278' to rotatably support the first end of the worm in the housing 272'. A clip 286' can be inserted into slots 290' that extend through the base 270' and open into the worm housing 272' to retain the worm 276' in the housing. A drive pulley 288' is attached to the second end of the worm 276' (e.g., to shaft 289'), to enable the worm to be driven by the transfer mechanism 254'. The worm housing 272' has a side opening 292' through the side wall 293' of the worm housing 272' between the first end opening 278' and the second end 280' facing the gear mount 274'. As described below, the side opening 292' provides access to the worm 276'. In the illustrated embodiments the side wall 293' of the worm housing 272' is generally concave to expose the worm 276.

The gear mount 274' includes a rim 294' that extends from the base 270' and is configured to support worm gear 296' for rotation by the worm 276'. In the illustrated embodiments, the worm gear 296' is mounted to the rim 294' by bearing 298'. The rim 294' is located on the base 270', and the bearing 298' and worm gear 296' is configured, so as to cause the teeth of the worm gear to engage the teeth of worm 276' through the side opening 292'. Worm gear 296' is thereby driven or rotated by rotation of the worm 276'. In the illustrated embodiments, the base 270', including the worm housing 272' and rim 294', is configured as a one-piece metal, plastic or other material member that can, for example, be molded, cast or otherwise formed using conventional or otherwise known manufacturing methods.

As shown, the drive pulley 288' may be configured with teeth or other surface features that assist with receiving an input force. A second portion 414' of the drive belt 400' is looped around the drive pulley 288'. The drive pulley 288' is configured to rotate (e.g., about the Z-axis) and is operatively coupled to the worm 276' to rotate the worm (e.g., about the Z-axis) in response to motion of the drive belt 400'. The worm 288' is a gear in the form of a screw with helical threading, and as discussed above is configured to engage with and rotate the worm gear 296' (e.g., about the Y-axis). Thus, the worm gear 296', which is similar to a spur gear, is rotatable via an input force on the drive pulley 288' causing the drive pulley to rotate.

The embodiments of the base 270' illustrated in FIG. 10 are the same as or similar to that of base 270 described in connection with FIG. 7, and include a second gear mount 274" with a second rim 294", and a second opening 292" in the worm housing 272'. However, the functionality of these features 274", 294" and 292" of the base 270' are not used by the rotary gearbox 260'. Because bases 270 and 270' can be identical, this component can be used in both dual arm rotary drive gearbox 260 and the single arm dual operating range gearbox 260', thereby enhancing manufacturing and supply efficiencies for these products.

As shown in FIG. 9 the linkage assembly 262' includes an arm 267 and a sash brace 269. The arm 267 has a proximal end portion 271 and distal end portion 273. The proximal end portion 271 of the arm 267 is coupled to the worm gear 296' (e.g., directly, or indirectly by being mounted to the bearing 298') such that the rotation of the worm gear imparts rotational forces on the arm. The proximal end 271 portion of arm 267 defines a central rotational axis 273 that is aligned with the rotational axis of the worm gear 296'. The distal end portion 273 of the arm 267 is pivotally connected to the sash brace 269 by a pivot connector 275, such that the rotational forces on the arm result in an opening or closing swing force in the Y-Z plane on the sash brace. The pivot connector 275 defines a rotational axis between the arm 267 and sash brace 269. The opening or closing swing force of the arm 267 is translated to the sash 24 (e.g., FIGS. 1A, 1B) by coupling the sash brace 269 to the sash (e.g., at the bottom rail 42 shown in FIGS. 1A, 1B).

Figure 12A:
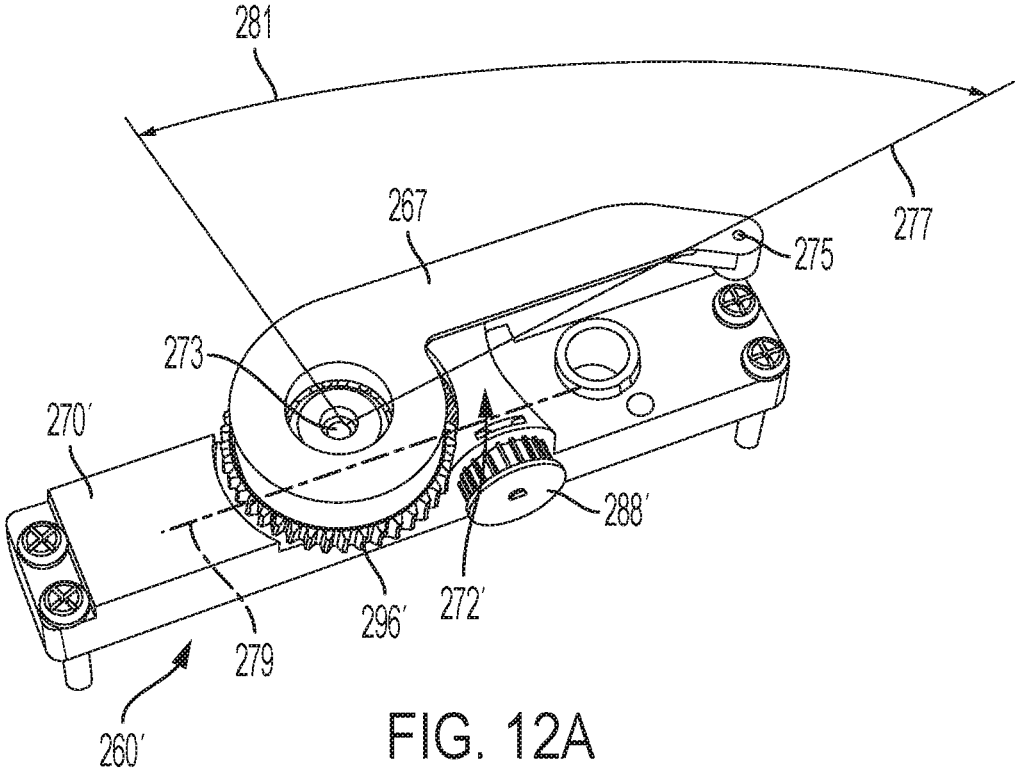
FIG. 12A is an isometric view of the rotary gearbox shown in FIG. 9 in a first or right hand hinge operating configuration.
Figure 12B:
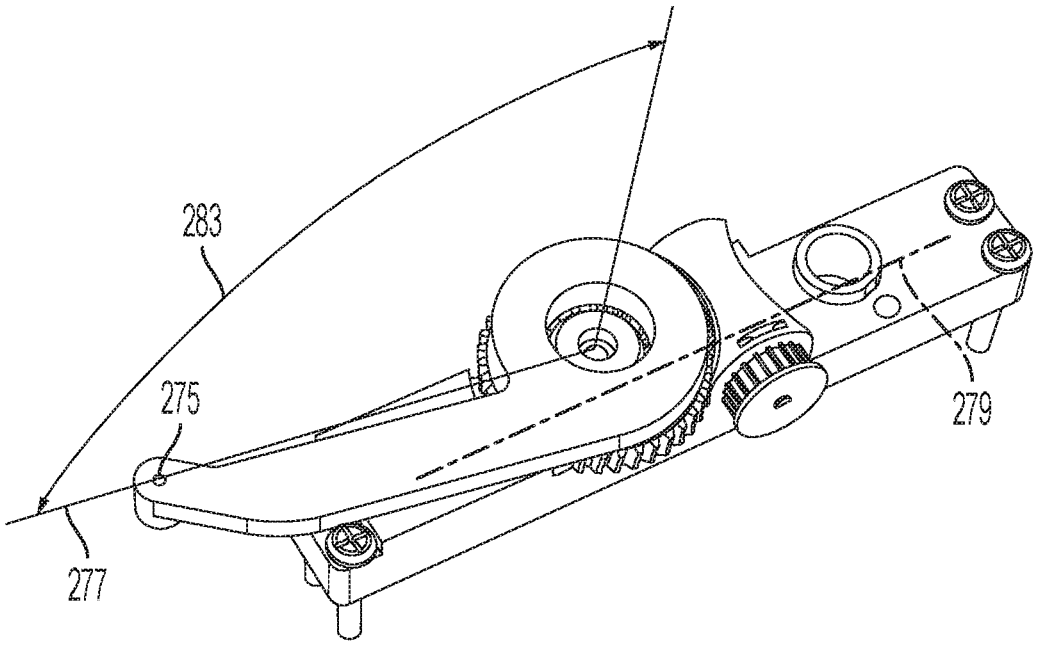
FIG. 12B is an isometric view of the rotary gearbox shown in FIG. 9 in a second or left hand hinge operating configuration.

FIGS. 12A and 12B illustrate the operation of the rotary gearbox 260'. As shown, because of the configuration as described and illustrated above, rotary gearbox 260' is capable of rotating the worm gear 296', and therefore the arm 267 connected to the worm gear, over an angular range of rotation of at least 270° in response to rotation of the drive pulley 288'. For purposes of description, the angular location of the arm 267 about its range of rotation is defined by an axis 277 that extends between the central rotational axis 273 of the arm 267 and the pivot connector 275 of the arm. A first end position (e.g., 0°) is defined for purposes of description and shown in FIG. 12A as the location of the arm 267 when the arm is at a location positioning the pivot connector 275 on a first side of the worm housing 272' opposite the worm gear 296'. In the embodiment illustrated in FIG. 12A, the axis 277 is generally parallel to an axis 279 transverse to the rotational axis of the pulley 288' when the arm 267 is at the first end position of its range of angular motion (e.g., the axis 277 is within about 5° to about 15° of being parallel to the axis 279). A second end position (e.g., 170°) is defined for purposes of description and shown in FIG. 12B as the location of the arm 267 when the arm is at a location positioning the pivot connector 275 on a second side of the worm housing 272' that is opposite the worm gear 296' from the worm housing. In the embodiment illustrated in FIG. 12B, the axis 277 is generally parallel to the axis 279 transverse to the rotational axis of the pulley 288' when the arm 267 is at the second end position of its range of angular motion (e.g., the axis 277 is within about 5° to about 15° of being parallel to the axis 279). In response to the rotation of drive pulley 288' the worm 276' is capable of rotating the worm gear 296' and arm 267 through the angular range of motion between the first end position and the second end position.

An advantage of rotary gearbox 260' is that it can be incorporated and used in fenestration units (such as the fenestration unit 10 show in FIGS. 1A, 1B) that have either a right hand hinge configuration (i.e., the sash is hinged to the first jamb 32 as shown in FIGS. 1A and 1B), or a left hand configuration (i.e., the sash is hinged to the second jamb 34). In either the right hand configuration or the left hand configuration, the slide mechanism 252' and the transfer mechanism 254' (e.g., as shown in FIG. 9) can be configured with the components including the handle 390', slide member 392', linear rail 394' on either jamb (e.g., jamb 32 or 34 in FIGS. 1A and 1B).

When configured for use in a first (e.g., right hand) configuration, the rotary gearbox 260' can be operated (e.g., in response to rotation of the drive pulley 288') over a first portion of its range of angular rotation. In this first configuration the first portion of the range of angular rotation is between a first portion first end position that is greater than or equal to the first end position (e.g., a position that corresponds to the right side hinged sash being fully closed) and a first portion second end position that is less than or equal to the second end position (e.g., a position that corresponds to the right side hinged sash being fully open). An example of a first portion 281 of the angular range of rotation is shown in FIG. 12A. The first portion 281 of the range of angular motion can be larger or smaller than the portion 281 shown in FIG. 12A, and the first portion first end position and the first portion second end position can be different positions than those shown in FIG. 12A.

When configured for use in a second (e.g., left hand) configuration, the rotary gearbox 260' can be operated (e.g., in response to rotation of the drive pulley 288') over a second portion of its range of angular rotation. In this second configuration the second portion of the range of angular rotation is between a second portion first end position that is less than or equal to the second end position (e.g., a position that corresponds to the left hinged sash being fully closed) and a second portion second end position that is greater than or equal to the first end position (e.g., a position that corresponds to the left hinged sash being fully open). An example of a second portion 283 of the angular range of rotation is shown in FIG. 12B. The second portion 283 of the range of angular motion can be larger or smaller than the portion 283 shown in FIG. 12B, and the second portion first end position and the second portion second end position can be different positions than those shown in FIG. 12B. Although the first portion 281 of the angular range and the second portion 283 of the angular range are shown as overlapping portions in FIGS. 12A and 12B as an example, in other embodiments the first and second portions of the range of angular motion do not overlap, or overlap by greater or lesser amounts.

Figure 13:
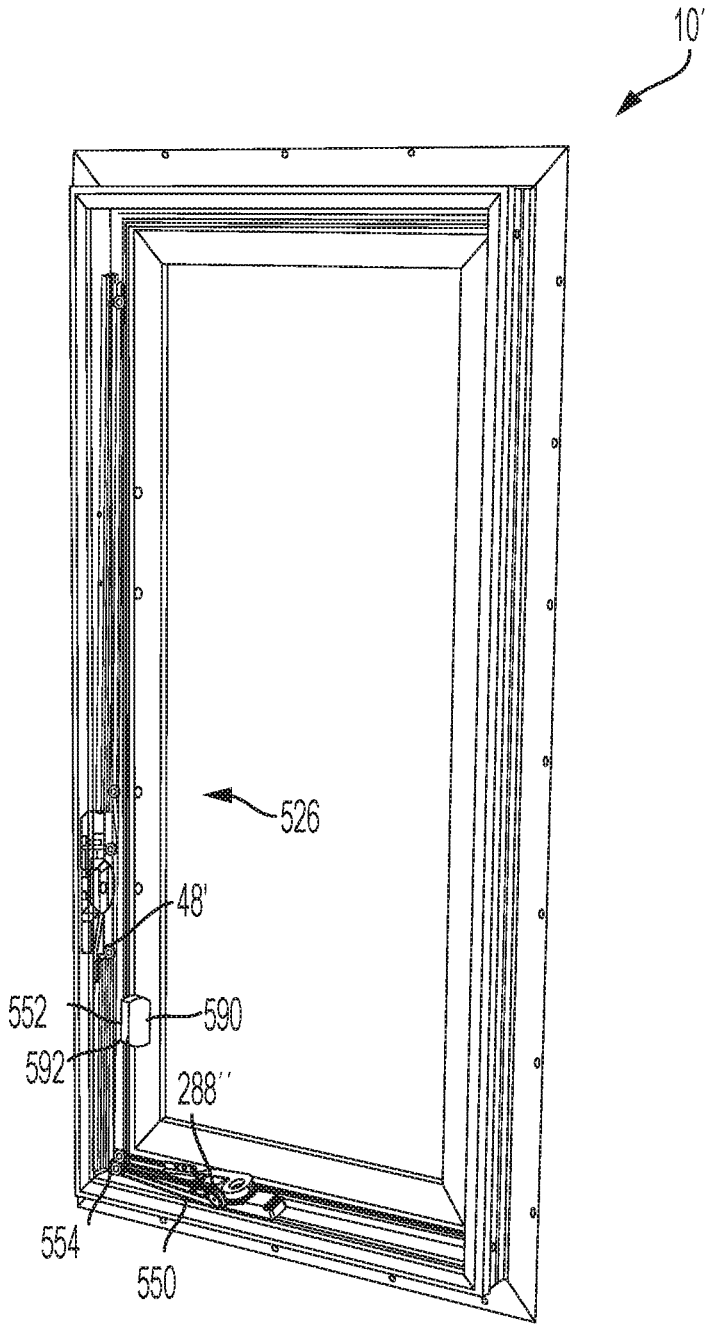
FIG. 13 is an isometric view of a casement fenestration unit, according to additional examples.

FIG. 13 is meant to show generally the same frame 22, head 30, first jamb 32, second jamb 34, and sill 36 as FIG. 1B. FIG. 13 is also meant to include the same top rail 40, bottom rail 42, first stile 44 and second stile 46, as well as latch assembly 47, including a handle 48. In FIG. 13, a similar drive mechanism 550, slide mechanism 552, and transfer mechanism 554 is to be employed to drive mechanism 250', slide mechanism 252', and transfer mechanism 254' shown in FIG. 9, with the slide mechanism 252' modified according to the slide mechanism 552 depicted in FIGS. 14 to 16. In particular, the modifications of FIGS. 14 to 16 to the slide mechanism 252' in the form of slide mechanism 552 help accommodate the latch assembly and lock handle. Thus, FIG. 13 is an isometric view of a fenestration unit 10' including an operator assembly 526 in accordance with embodiments. As referenced, fenestration unit 10' can be the same as or similar to fenestration unit 10 described above with reference to FIGS. 1A and 1B, and similar reference numbers are used to identify similar components. An operator assembly 526 includes drive mechanism 550, slide mechanism 552, and transfer mechanism 554 operatively coupling the slide and drive mechanisms. In general terms, the operator assembly 526 is configured to receive a first, linear input from a user of the fenestration unit 10' along a first axis (e.g., a Y- or vertical axis), which is transferred along a second axis (e.g., an X- or horizontal axis) to cause the operator assembly to impart an opening or closing force on the sash 24' of the fenestration unit. The drive mechanism 550 is configured to receive an input force (e.g., linear or rotational) from the slide mechanism 552 through the transfer mechanism 554 and to translate that input force into an opening force on the sash 24' toward the open position and a closing force toward a closing position. Drive mechanism 550 can be the same as or similar to drive mechanism 250' described in connection with FIGS. 9-11, 12A and 12B, and similar reference number are used to identify similar components. As described in greater detail below, slide mechanism 552 and transfer mechanism 554 are similar to slide mechanism 252 and transfer mechanism 254, respectively, described in connection with FIG. 6, but are configured for mounting on the side of the frame 22' of fenestration unit 10' having the latch assembly including the handle 48' (i.e., on the side with second jamb 34'), and opposite the side to which the sash 24' is hinged (i.e., the side with first jamb 32'). This configuration is in contrast to the slide mechanism 252 and transfer mechanism 254 of fenestration unit 10 that include components mounted on a side of the fenestration unit that does not have the latch assembly including handle 48 (i.e., on the side with jamb 32 in FIGS. 1A, 1B) which is the same side of the fenestration unit to which the sash 24 is hinged.

Slide mechanism 552 and components of transfer mechanism 554 are located on the second jamb 34' of the frame 22' of fenestration unit 10'. Slide mechanism 552 includes a handle 590, a slide member 592 coupled to the handle, and a linear rail 594 (FIG. 14) along which the slide member is slidably received. Rail 594 is mounted to jamb 34' (i.e., the jamb to which the latch assembly 47' and the handle 48' are mounted), and includes a first section 593 and a second section 595. First section 593 of the rail 594 is located on a first side of the handle 48' (e.g., on the side between the handle and head 30' of the frame 22' in the illustrated embodiments), and the second section 595 of the rail is located on a second, opposite side of the handle (e.g., on the side between the handle and sill 36' in the illustrated embodiments). The rail 594 thereby defines a rail gap section 591 adjacent to the latch assembly 47' and/or handle 48' where there is no rail section that might otherwise interfere with the latch assembly and/or handle and their functionality. The slide member 592 also includes an attachment mechanism (e.g., ribbed teeth) for operatively coupling with the transfer mechanism 554. In various embodiments the linear rail 594 is associated with (e.g., attached to or integrally formed as part of) the frame 22' (e.g., the second jamb 34'). In this manner, a user is able to grasp the handle 590 on the slide mechanism 552 and slide member 592 linearly (e.g., vertically, along the second jamb 34'). As subsequently described, this linear motion is translated through the transfer mechanism 554 to the drive mechanism 550. The handle 590 is arranged to project inwardly toward the center of the fenestration unit 10' in the illustrated embodiment, although the handle can also be modified to project interiorly, from the interior side of the fenestration unit in other embodiments.

In embodiments, the full range of motion of the sash 24' as it is driven between its fully closed and fully open positions can be provided by motion of the handle 590 and slide member 592 along the first section 593 of the rail 594. In embodiments of this type, slide mechanism 552 need not include the second portion 595 of the rail 594. In other embodiments, the full range of motion of the sash 24 as it is driven between its fully closed and fully open positions can be provided by motion of the handle 590 and slide mechanism 552 along both the first section 593 and second section 595 of the rail 594. In embodiments of this type the first section 593 of the rail 594, the second section 595 of the rail and/or the slide mechanism 552 can be configured to enable the slide mechanism to transition between the first and second rail sections and across the rail gap section 591.

The transfer mechanism 554 is shown to include a drive belt 600, a first transfer block 602, a second transfer block 604, a first jump transfer block 603 and a second jump transfer block 605. The drive belt 600 can be a ribbed or toothed belt that is flexible and resilient. The first transfer block 602 includes a pulley system having a pulley 606 that the drive belt 600 is able to travel around and reverse direction. In embodiments, the first transfer block 602 is located along the second jamb 34' of the fenestration unit 10', toward the head 30'. The second transfer block 604 includes a pulley system having pulleys 607 and 608, and is configured to redirect the drive belt 600 direction of travel between a generally horizontal path, axis or direction to a generally vertical path, axis or direction. In embodiments, the second transfer block 604 is located toward a corner of the fenestration unit 10', toward the intersection of the second jamb 34' and the sill 36'.

The drive belt 600 has a first portion 610 looped around the first transfer block 602, an intermediate portion 612 looped past the second transfer block 604, and a second portion 614 looped around the drive pulley 288" of the drive mechanism 550. The ends of the drive belt 600 are secured to the slide member 592. In this manner, the drive belt 600 extends along two sides of the frame 22' of the fenestration unit 10', including over at least portions of the latch assembly 47' and/or the handle 48', in a continuous loop (i.e., along the second jamb 34' and then along the sill 36'). The drive belt 600 is coupled to the slide member 592 by an attachment mechanism (e.g., ribbed teeth). In operation, the handle 590 is slid along a first axis (e.g., upwardly or downwardly along the Y-axis), resulting in the drive belt 600 being driven along the Y-axis and then along the X-axis through a generally perpendicular path, which then results in turning of the drive pulley 288" of the drive mechanism 550. The belt 600 functions as a linkage member coupling the slide mechanism 552 to the drive mechanism 550. As previously described, actuation of the drive pulley 288" (e.g., by imparting an actuation force through the drive belt 600) causes the drive mechanism 550 to open and close the sash 24'. In other words, the slide mechanism 552 is operatively coupled to the drive mechanism 550 via the transfer mechanism 554, the slide mechanism being slidable to cause the drive mechanism to impart the opening force and the closing force, respectively, on the sash 24'.

Figure 14:
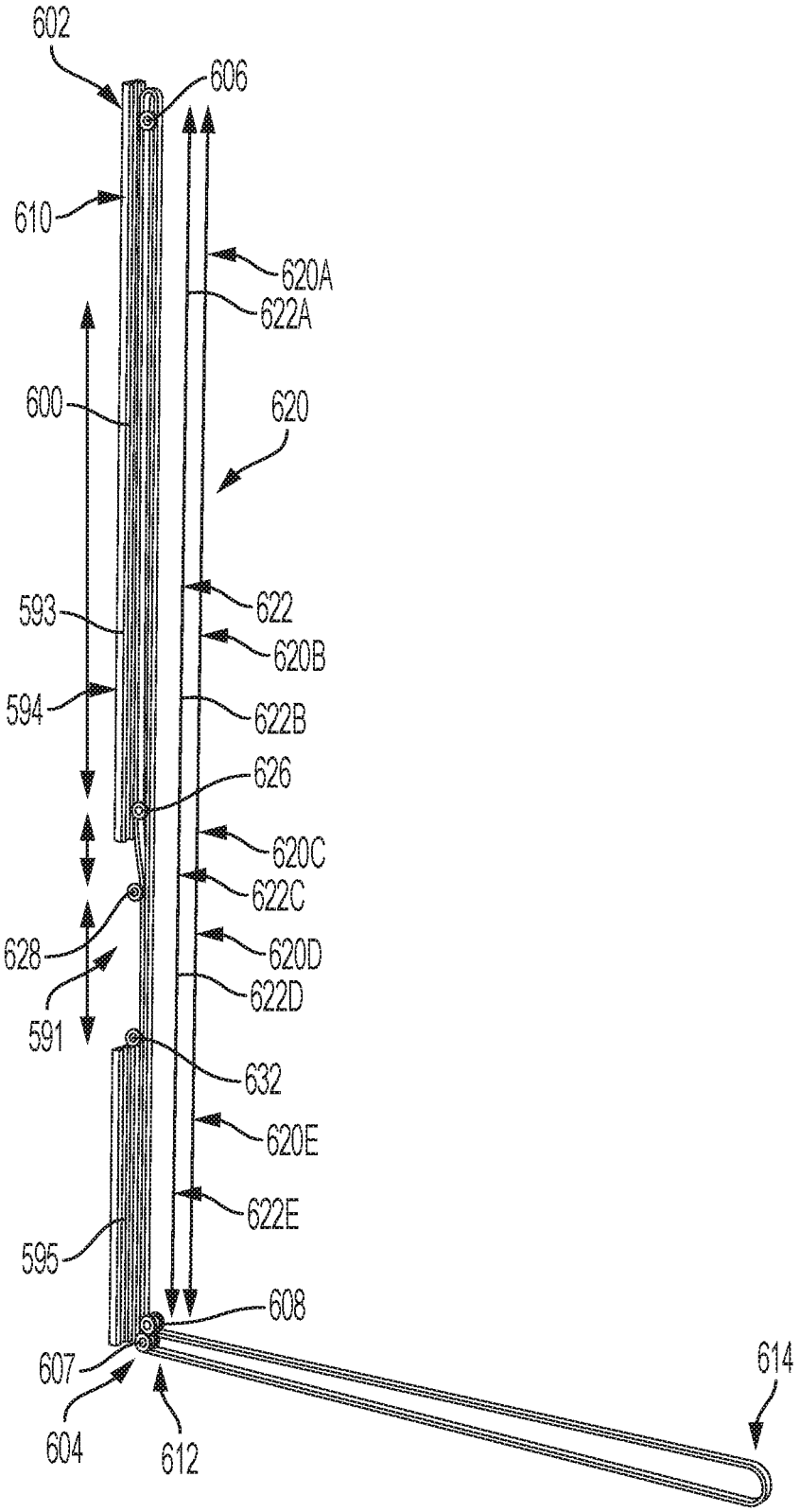
FIG. 14 is a detailed isometric view of the slide assembly and transfer mechanism of the fenestration unit shown in FIG. 13.
Figure 15:
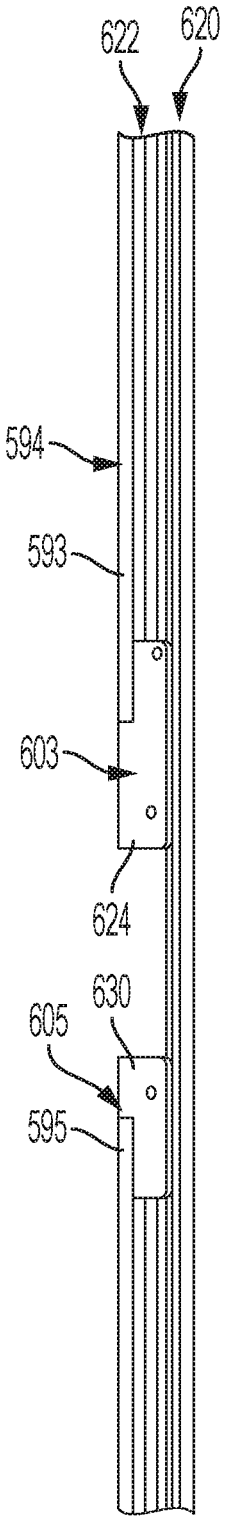
FIG. 15 is a detailed isometric view of a lock jump portion of the slide assembly and transfer mechanism shown in FIG. 14.

As perhaps best shown in FIG. 14, the pulley 606 of the first transfer block 602 and the pulleys 607, 608 of the second transfer block 604 generally define a first travel path 620 and a second travel path 622 of the drive belt 600 along the second jamb 34'. The second travel path 622 extends between the first end pulley 606 of the first transfer block 602 and the pulley 607 of the second transfer block 604, and is the path that portions of the drive belt 600 traverse adjacent and closest to the jamb 34' as the belt is driven. The first travel path 620 extends between the pulley 606 of the first transfer block 602 and the pulley 608 of the second transfer block 604, and is the path that portions of the drive belt 600 traverse opposite the second travel path 622 from the jamb 34' as the belt is driven (i.e., the path closest to the interior of the frame 22').

The first and second travel paths 620, 622 each include a number of sections. In the illustrated embodiments, the first and second travel paths have, respectively, (1) first and second end sections 620A and 622A, (2) first and second first rail sections 620B and 622B, (3) first and second transition sections 620C and 622C, (4) first and second lock sections 620D and 622D, and (5) first and second rail sections 620E and 622E. The first and second end sections 620A and 622A are traversed by the first portion 610 of the belt 600. The first and second first rail sections 620B and 622B extend along the first section 593 of the first rail 594, and are generally parallel to one another in the illustrated embodiment. The first and second lock sections 620D and 622D extend over and adjacent to the latch assembly 47' and/or handle 48' on the jamb 34', and are shown generally parallel to one another in the illustrated embodiment. The first and second transition sections 620C and 622C extend between the first and second first rail sections 620B and 622B and the first and second lock sections 620D and 622D, respectively. The first and second rail sections 620E and 622E extend along the second section 595 of the rail 594, between the first and second lock sections 620D, 622D and the second transfer block 604, respectively, and are shown generally parallel to one another in the illustrated embodiment.

The first jump transfer block 603 and second jump transfer block 605 are configured to support and position the drive belt 600 at the first and second transition sections 620C, 622C and the first and second lock sections 620D, 622D of the first and second travel paths 620, 622, respectively. In embodiments, the first jump transfer block 603 includes a frame 624 that supports a first jump pulley 626 and a second jump pulley 628. The frame 624 of the first jump transfer block 603 can be mounted to the second jamb 34' of the frame 22' at a location between the latch assembly 47' and/or lock handle 48' and the head 30' of the frame. In the illustrated embodiments, the frame 624 is located between the lock handle 48' and an end of the first section 593 of the rail 594. In embodiments, the second jump transfer block 605 includes a frame 630 that supports a third jump pulley 632. The frame 630 of the second jump transfer block 605 can be mounted to the second jamb 34' of the frame 22' at a location between the latch assembly 47' and/or lock handle 48' and the second transfer block 604. In the illustrated embodiments, the frame 630 of the second jump transfer block 605 is located between the lock handle 48' and an end of the second section 595 of the rail 594.

First end pulley 605 has a diameter D1 that generally defines the spacing or distance between the first and second travel paths 620 and 622 at the first and second end sections 620A and 622A, respectively. The first jump pulley 626 has a diameter D2 that defines the spacing between the first and second travel paths 620 and 622 at the intersection of the first and second first rail sections 620B, 622B, and the first and second transition sections 620C, 622C, respectively. In the illustrated embodiments, diameters D1 and D2 are generally equal, causing the first end section 620A and the first first rail section 620B to be generally parallel to the second end section 622A and the second first rail section 622B. The first jump pulley 626 and the pulley 608 of second transfer block 604 are configured to position the first transition section 620C, the first lock section 620D and the first second rail section 620E of the first travel path 220 generally colinear to one another, and colinear with the first first rail section 620B in the illustrated embodiment. Second jump pulley 628 and third jump pulley 632 support the second lock section 622D of the second travel path 622 at location that is spaced apart from the latch assembly 47' and/or lock handle 48' to reduce interference between the latch assembly and/or lock handle and the drive belt 600. The functionalities of the drive belt 600 and the latch assembly 47' and/or handle 48' are therefore not affected by each other.

Figure 16:
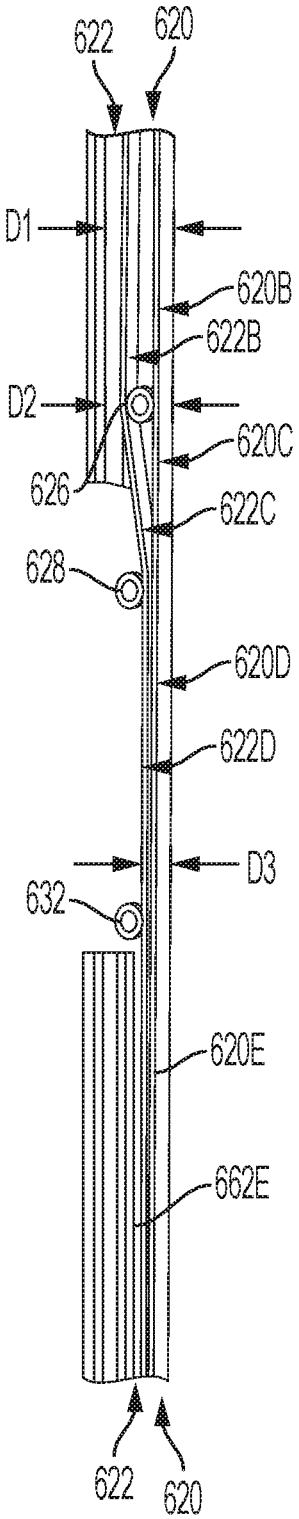
FIG. 16 is a detailed isometric view of a lock jump portion of the slide assembly and transfer mechanism shown in FIG. 14.

As perhaps best shown in FIG. 16, the first jump pulley 626 and the second jump pulley 628 are configured to transition the spacing between the first and second travel paths 620 and 622 from the distance D2 defined by the first jump pulley to a distance D3 that is less than the distance D2. In the illustrated embodiments this transition is done by the second jump pulley 628 locating the second lock section 622D of the second travel path 622 closer to the first lock section 620D of the first travel path 622, away from the latch assembly 47' and/or lock handle 48'. Clearance between the drive belt 600 and the latch assembly 47' and/or lock handle 48' is thereby increased to reduce interference between the latch assembly 47' and/or lock handle 48' and the drive belt as described above. In the illustrated embodiment the third jump pulley 632 and the pulleys 607 and 608 of the second transfer block 604 are configured to cause the spacing between the first and second rail sections 620E, 622E to be the same as distance D3. Other embodiments (not shown) are configured to provide other spacings between the various sections 620A-620E and 622A-622E of the first and second travel paths, respectively, while providing interference-reducing clearance between the latch assembly 47' and/or lock handle 48' and the belt 600. Structures similar to those described above can also be configured to provide interference-reducing clearance between the latch assembly 47' and the belt 600.

Figure 17:
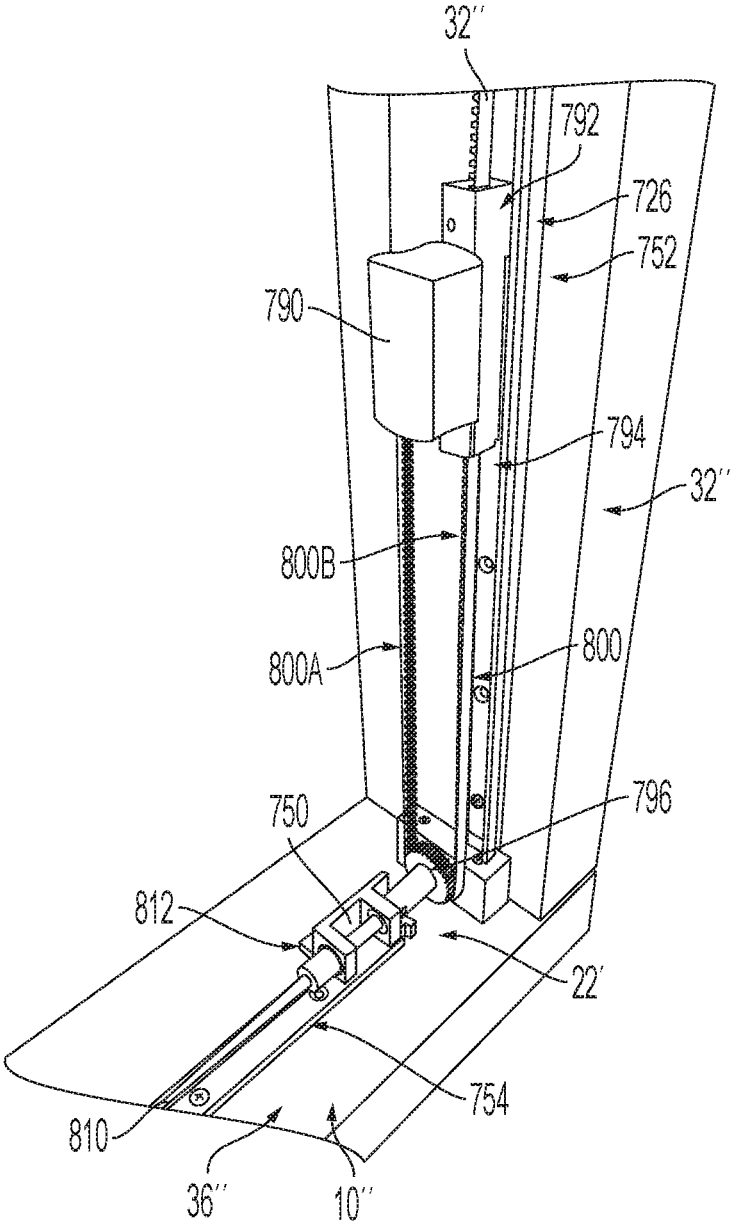
FIG. 17 is a detailed isometric illustration of an operator assembly according to additional examples.
Figure 18:
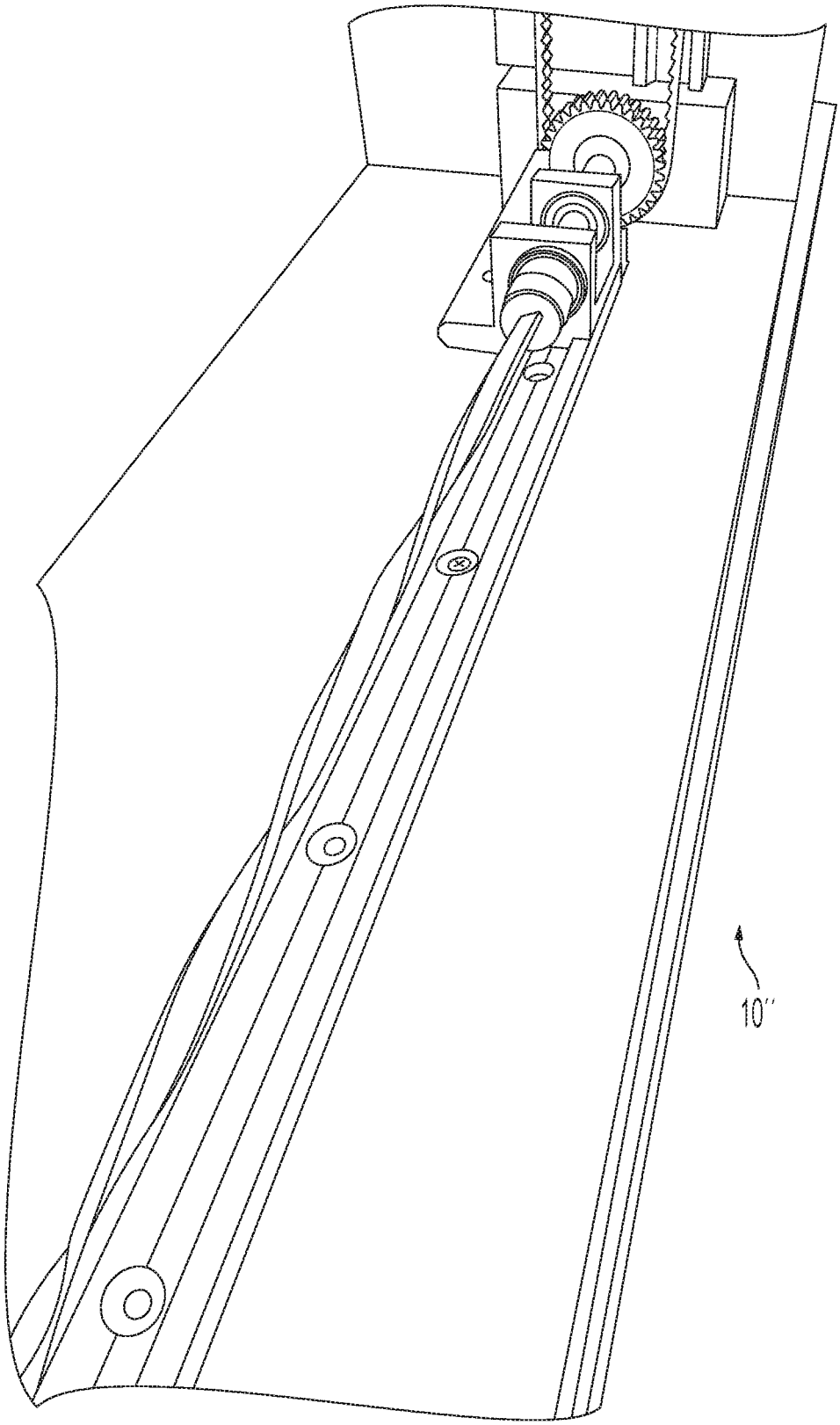
FIG. 18 is a detailed isometric illustration of a portion of the transfer mechanism of the operator assembly shown in FIG. 18.
Figure 19:
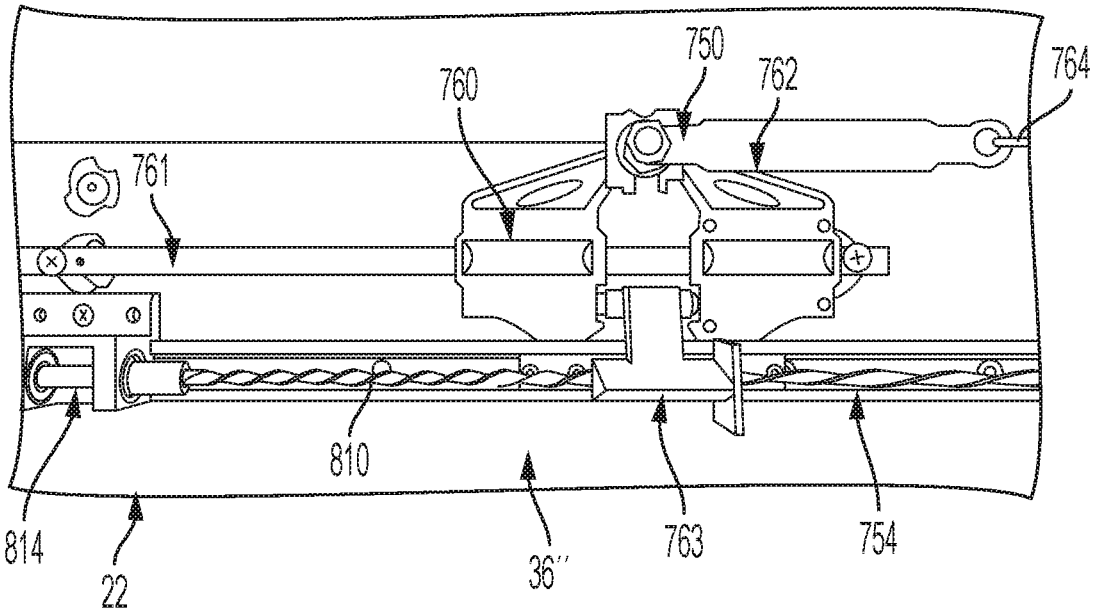
FIG. 19 is a detailed illustration of portions of the transfer mechanism and drive mechanism of the operator assembly shown in FIG. 17.

FIGS. 17-19 illustrate a fenestration unit 10" that includes an operator assembly 726 in accordance with embodiments. Fenestration unit 10" can be the same as or similar to fenestration unit 10 described above with reference to FIGS. 1A and 1B, and similar reference numbers are used to identify similar components. As shown, the operator assembly 726 includes a drive mechanism 750, slide mechanism 752, and transfer mechanism 754 operatively coupling the slide and drive mechanisms. In general terms, the operator assembly 726 is configured to receive a first, linear input for a user of the fenestration unit 10" along a first axis (e.g., a Y- or vertical axis), which is transferred along a second axis (e.g., an X- or horizontal axis) to cause the operator assembly to impart an opening or closing force on the sash (not shown in FIGS. 17-19) of the fenestration unit. The drive mechanism 750 is configured to receive an input force (e.g., linear or rotational) from the slide mechanism 752 through the transfer mechanism 754 and to translate that input into an opening force on the sash toward the open position and a closing force toward a closing position.

The drive mechanism 750 is configured to receive an input force from the transfer mechanism 754 (e.g., an axial twisting or rotational force along the X- or horizontal axis as described in greater detail below) in response to the user actuation of the slide mechanism 752, and to translate that input into an opening force on the sash toward the open position and a closing force on the sash toward the closed position. As shown in FIG. 19, the drive mechanism 750 includes a slide member 760 that is configured for generally linear, reciprocal back-and-forth motion in response to the input force provided by the transfer mechanism 754, a linkage assembly 762 including link 764 coupling the slide member 760 to the sash, and carriage 763 operatively coupling the slide member to the transfer mechanism. In the illustrated embodiment the slide member 760 is mounted to a guide rod 761 on the sill 36" of the frame 22" of the fenestration unit 10". The slide member 760 slides on the guide rod 761, and the guide rod defines the path of reciprocal motion over which the slide member travels in response to forces provided by the transfer mechanism 754.

The slide mechanism 752 includes a handle 790, a carriage or slide member 792 coupled to the handle, and a linear rail 794 along which the slide member is slidably received. The slide member 792 also includes an attachment structure (e.g., teeth) for operatively coupling with the transfer mechanism 754. In various examples the linear rail 794 is associated with (e.g., attached to or integrally formed as part of) the frame 22", such as the first jamb 32". In this manner, a user is able to grasp the handle 790 of the slide mechanism 752 and slide the slide member 792 linearly (e.g., vertically) along the first jamb 32". As described in greater detail below, this linear motion is translated through the transfer mechanism 754 to the drive mechanism 750. In the embodiments shown in FIG. 17, the handle 790 is arranged to project inwardly toward the center of the fenestration unit 10", although the handle can also be modified to project interiorly, from the interior side of the fenestration unit.

The transfer mechanism 754 includes pulleys 796 and 798 that are mounted for rotation on the first jamb 32", and a drive belt 800 that is looped around and engages the pulleys. As perhaps best shown in FIG. 17, the pulleys 796 and 798 rotate about axes that are perpendicular to the jamb 32". The pulleys 796 and 798 thereby position the two opposed length sections 800A and 800B of the drive belt 800 adjacent the jamb 32" (e.g., both length sections can be positioned at the same distance from the jamb 32") and space the two length sections with respect to each other along the Z-axis (i.e., the depth dimension of the fenestration unit 10"). As shown in FIG. 17, the slide member 792 is coupled to the length section 800B of the drive belt 800. Linear motion of the handle 790 by the operator is thereby translated into movement of the drive belt 800 (i.e., along a vertical axis) and rotation of the pulley 796 along the Z-axis. In the illustrated embodiment the pulley 796 has teeth to enhance the transfer of forces from the drive belt 800 to the pulley.

Transfer mechanism 754 includes also a twisted wire 810 that is a tape-like or band-like drive member that is twisted to define a desired number of turns, or twisted at a desired frequency. Twisted wire 810 can be similar to the twisted wire 100 described above in connection with FIGS. 1A, 1B, 2 and 4. The twisted wire 810 is mounted to the sill 36" by bearing mounts 812 and 814 for rotation about the longitudinal axis of the twisted wire (e.g., about the X-axis). An end of the twisted wire 810 is coupled to the pulley 796. The rotation of the pulley 796 in response to the sliding of the handle 790 thereby drives and rotates the twisted wire 810. Pulley 796 thereby functions as a transfer mechanism, translating the vertical motion of the drive belt 800 caused by the sliding motion of the handle 790 into rotation or rotary motion of the twisted wire 810 about the X-axis.

The twisted wire 810 extends through a slot or channel (not visible) in the carriage 763 of the drive mechanism 750. Rotation of the twisted wire 810 thereby causes the carriage 763 to travel along the twisted wire. The carriage 763 thereby converts the rotatory motion of the twisted wire 810 to the linear motion of the slide member 760 of the drive mechanism 750.

FIGS. 20, 21, 22A, 22B, 23, 24, 25A, 25B, 26A and 26B illustrate a fenestration unit 10'" including an operator assembly 926 in accordance with embodiments. Fenestration unit 10'" can be the same as or similar to fenestration unit 10 described above with reference to FIGS. 1A and 1B, and similar reference numbers are used to identify similar components. As shown, the operator assembly 926 includes a drive mechanism 950, slide mechanism 952, and transfer mechanism 954 operatively coupling the slide and drive mechanisms. In general terms, the operator assembly 926 is configured to receive a first, linear input from a user of the fenestration unit 10'" along a first axis (e.g., a Y- or vertical axis), which is transferred along a second axis (e.g., an X- or horizontal axis) to cause the operator assembly to impart an opening or closing force on the sash 24'" of the fenestration unit. The drive mechanism 950 is configured to receive an input force (e.g., linear or rotational) from the slide mechanism 952 through the transfer mechanism 954 and to translate that input into an opening force on the sash 24'" toward the open position and a closing force toward a closing position. The drive mechanism 950 is configured to receive an input force from the transfer mechanism 954 (e.g., linear or rotational) from the slide mechanism 952 through the transfer mechanism 954 and to translate that input into an opening force on the sash 24'" toward the open position and a closing force on the sash toward the closed position. The drive mechanism 950 includes a rotary gearbox 960 and a linkage assembly 962.

Rotary gearbox 960 is configured as a multistage reduction spur device and can be described with reference to FIGS. 22A, 22B, 23, 24, 25A, 25B, 26A and 26B. Generally, the gearbox 960 receives an input force (e.g., linear or rotational) which is translated into a rotational force on the linkage assembly 962 to which the rotary gearbox is operatively coupled. The gearbox 960 includes a housing 964 that substantially encloses and supports an input stage 966 that includes a drive pulley 968, an output stage 970 that includes an output spur gear 972 coupled to the linkage assembly 962, and one or more spur gear reduction stages such as 974, 976 and 978 that couple the input stage to the output stage. Although three spur gear reduction stages are shown in the illustrated embodiments, other embodiments include more or fewer such stages.

Input stage 966, output stage 970 and reduction stages 974, 976 and 978 are mounted with respect to a base 980 of the housing 964 by bearings for rotation about rotational axes 966*a*, 970*a*, 974*a*, 976*a* and 978*a*, respectively. Rotational axes 966*a*, 970*a*, 974*a*, 976*a* and 978*a* are all parallel to one another in the illustrated embodiments. In the illustrated embodiments, the drive pulley 968 of the input stage 966 includes a spur gear. The input stage 966 also includes a pinion spur gear 982 that is coupled to and rotated about the axis 966*a* by the drive pulley 968. Reduction stage 974 includes spur gear 984 that engages the pinion spur gear 982 of the input stage 966, and pinion spur gear 986 that is coupled to and rotated about the axis 974*a* by the spur gear 984. Reduction stage 976 includes spur gear 988 that engages the pinion spur gear 986 of the reduction stage 974, and a pinion spur gear 990 that is coupled to and rotated about the axis 976*a* by the spur gear 988. Reduction stage 978 includes spur gear 992 that engages the pinion spur gear 990 of the reduction stage 976, and a pinion spur gear 994 that is coupled to and rotated about the axis 978*a* by the spur gear 992. The pinion spur gear 994 of the reduction stage 978 engages and rotates the spur gear 972 of the output stage 970 about the axis 970*a*.

Input stage 966, output stage 970, and the reduction stages 974, 976 and 978 cooperate to produce a N:1 reduction ratio between the rotational rates of the input stage and the output stage, where N is greater than one. In embodiments, the rotary gearbox 960 is configured to provide a 20:1 reduction ration. Other embodiments can be configured to provide greater or lesser reduction ratios.

Figure 20:
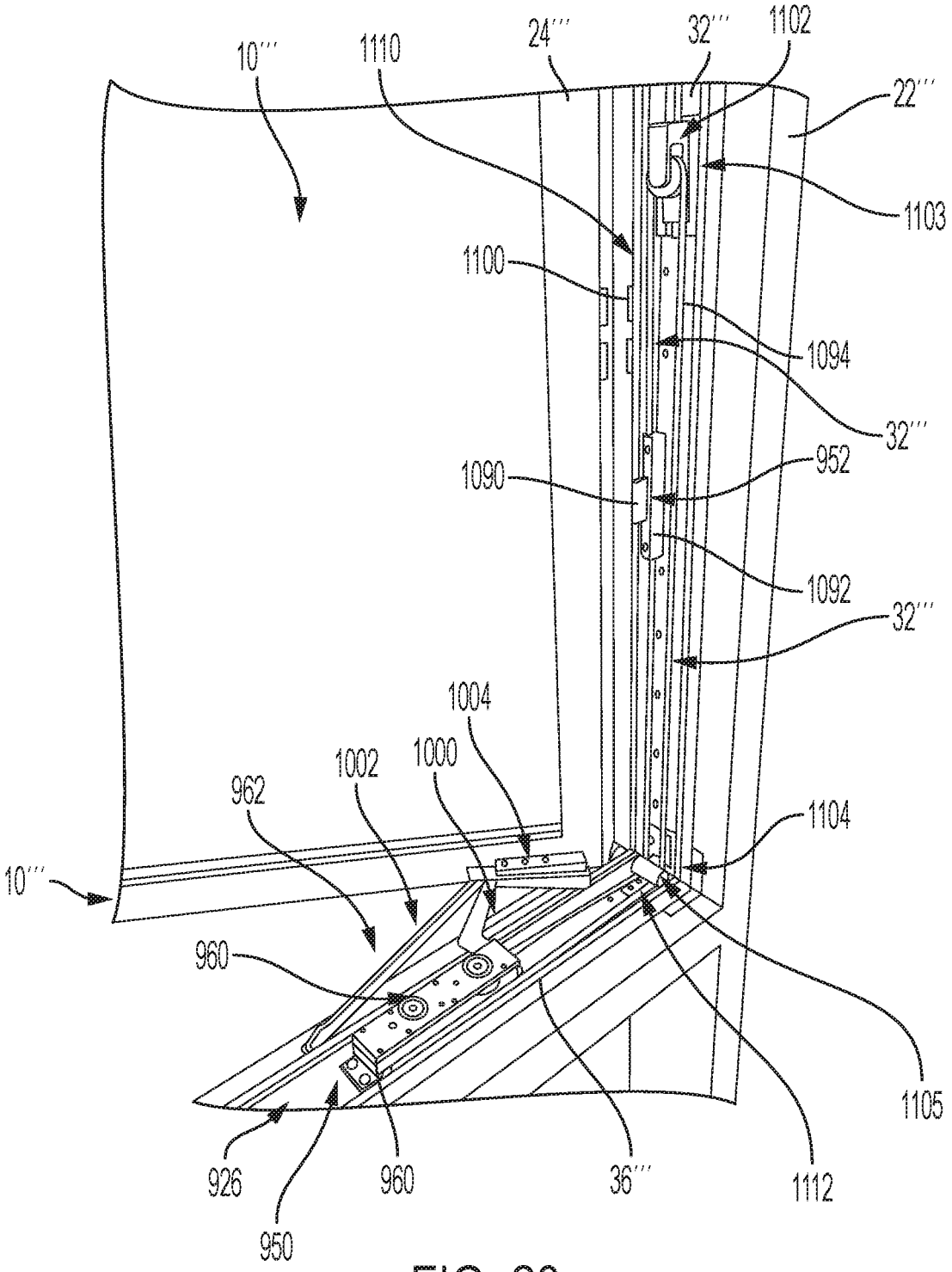
FIG. 20 is an isometric view of portions of a fenestration unit including an operator assembly according to additional examples.

FIG. 20 shows the linkage assembly 962. The illustrated embodiments of linkage assembly 962 include arm 1000, arm 1002 and sash bracket 1004. Sash bracket 1004 is mounted to the sash 24". A first or proximal end of the arm 1000 is coupled to and rotated by the output spur gear 972 of the rotary gearbox 960. A second or distal end of the arm 1000 is pivotally connected to the sash bracket 1004. Arm 1002 has a first end pivotally connected to sash bracket 1004, and a second end that slides along the sill 36'''.

Figure 21:
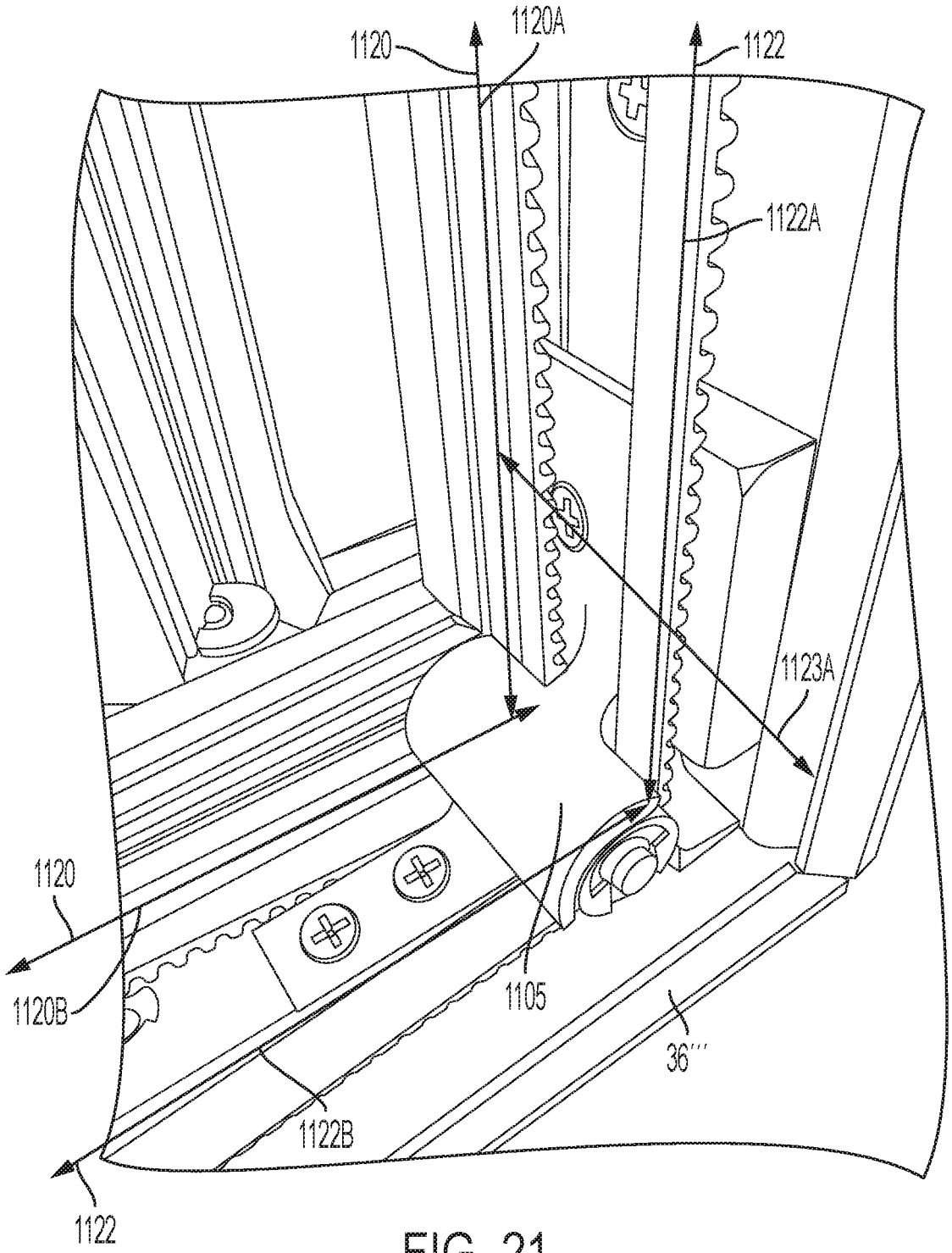
FIG. 21 is a detailed isometric view of a portion of the transfer mechanism of the operator assembly shown in FIG. 20.
Figure 22A:
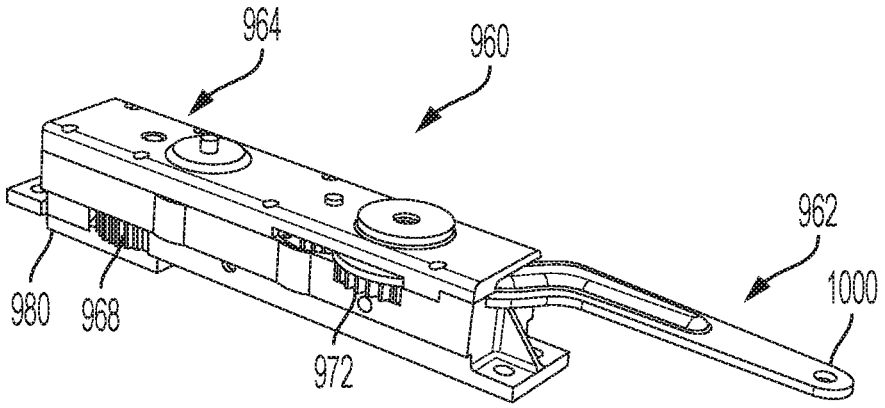
FIGS. 22A and 22B are isometric views of the rotary gearbox of the operator assembly shown in FIG. 20.
Figure 22B:
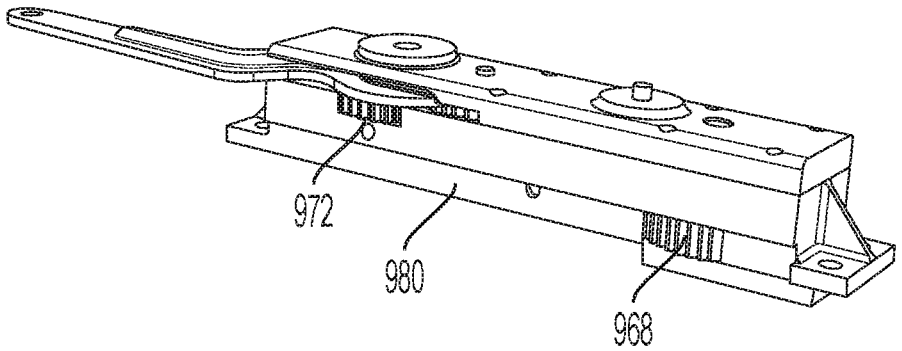
Figure 23:
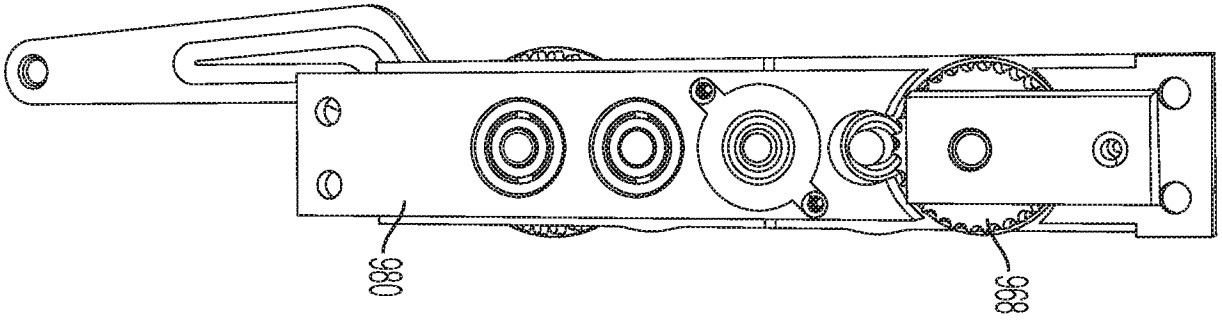
FIG. 23 is a bottom plan view of the rotary gearbox shown in FIG. 20.
Figure 24:
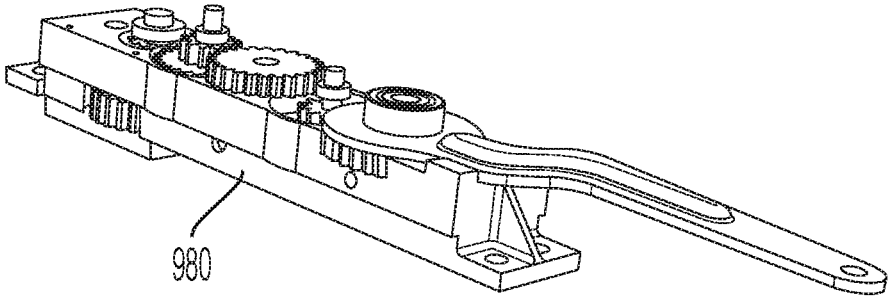
FIG. 24 is an isometric view of the rotary gearbox shown in FIG. 20, with portions of a housing removed.
Figure 25A:
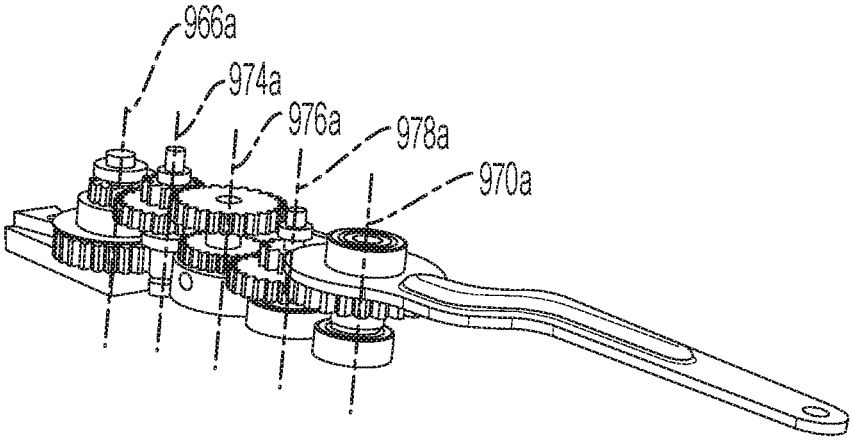
FIGS. 25A and 25B are detailed isometric views of the rotary gearbox shown in FIG. 20, with portions the housing removed.
Figure 25B:
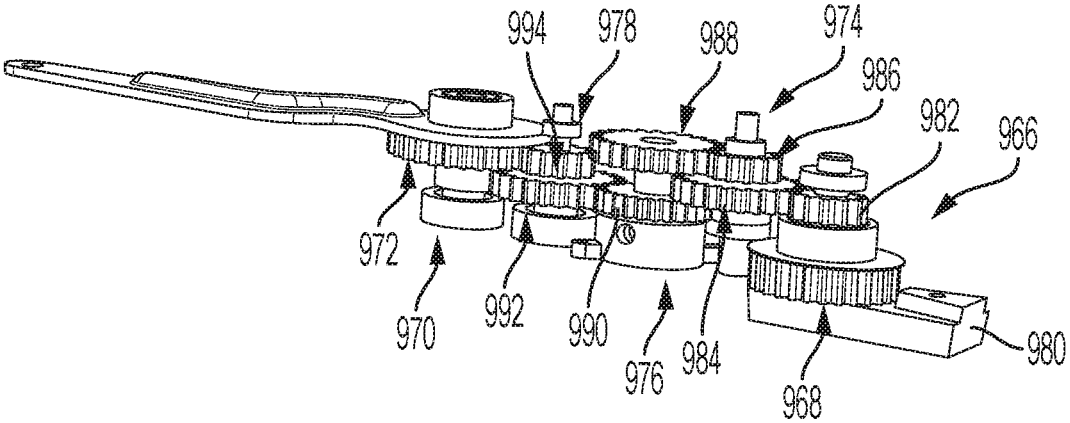
Figure 26A:
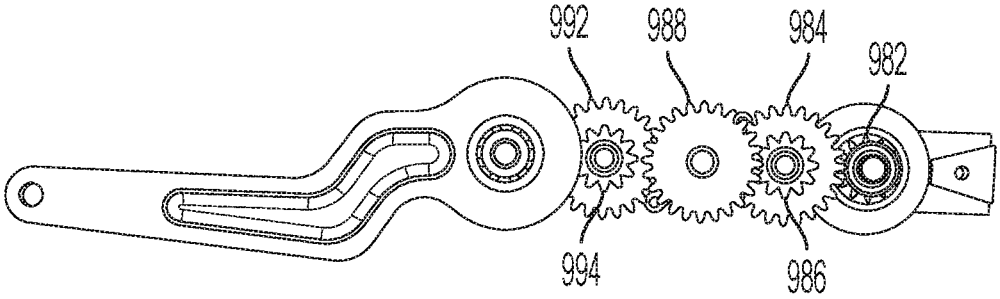
FIG. 26A is a top plan view of the rotary gearbox shown in FIG. 20, with portions of the housing removed.
Figure 26B:
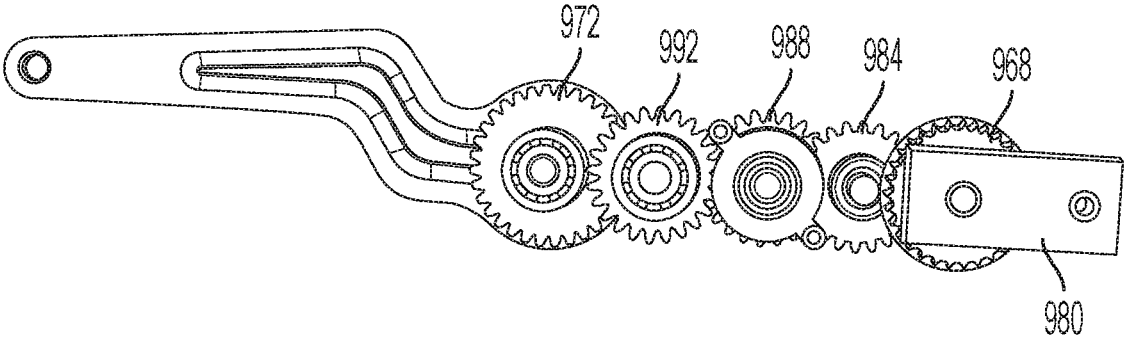
FIG. 26B is a bottom plan view of the rotary gearbox shown in FIG. 20, with portions of the housing removed.

Slide mechanism 952 and transfer mechanism 954 can be described with reference to FIGS. 20 and 21. As shown, the slide mechanism 952 includes a handle 1090, a slide member 1092 coupled to the handle, and a linear rail 1094 along which the slide member 1092 is slidably received. The slide member 1092 includes an attachment mechanism (e.g., ribbed teeth) for operatively coupling with the transfer mechanism 954. In various embodiments the linear rail 1094 is associated with (e.g., attached to or integrally formed as part of) the frame 22''', such as the first jamb 32'''. In this manner, a user is able to grasp the handle 1090 of the slide mechanism 952 and slide the slide member 1092 linearly (e.g., vertically) along the first jamb 32'''. As subsequently described, this linear motion is translated through the transfer mechanism 954 to the drive mechanism 950.

Transfer mechanism 954 includes a drive belt 1100, a first transfer block 1102 and a second transfer block 1104. The drive belt 1100 is a generally ribbed or toothed belt in the illustrated embodiments, and is flexible and resilient. The first transfer block 1102 includes a first, end or turn around pully 1103 that the drive belt 1100 is able to travel around and reverse direction. As shown, the pulley 1103 is located along the first jamb 32''' toward the head (not shown in FIG. 20). The second transfer block 1104 includes a second or corner pulley 1105 and is configured to redirect the direction of travel of the drive belt 1100 between a generally horizontal path, axis or direction (e.g., along sill 36''') and a generally vertical path, axis or direction (e.g., along jamb 32'''). The second transfer block 1104 is located toward a corner of the frame 22' in the illustrated embodiment.

The drive belt 1100 has a first portion 1110 looped around the pulley 1103 of the first transfer block 1102, an intermediate portion 1112 looped past the pulley 1105 of the second transfer block 1104, and a second portion 1114 looped around the drive pulley 968 of the rotary gearbox 960. In this manner the drive belt 1100 extends along the first jamb 32' and then along the sill 36''' in a continuous loop. As shown, the drive belt 1100 is coupled to the slide member 1092 using the attachment mechanism (e.g., ribbed teeth). In operation, the handle 1090 is slid along a first axis (e.g. upwardly or downwardly along the Y-axis), resulting in the drive belt 1100 being driven along the Y-axis and along the X-axis through a generally perpendicular path (i.e., a non-zero angle), which results in turning of the drive pulley 968. As previously referenced, actuation of the drive pulley 968 causes the drive mechanism 950 to open and close the sash 24'''. In other words, the slide mechanism 952 is operatively coupled to the drive mechanism 950 via the transfer mechanism 954, the slide mechanism being slidable to cause the drive mechanism to impart the opening force and the closing force on the sash 24'.

Pulley 1103 of the first transfer block 1102, pulley 1105 of the second transfer block 1104 and drive pulley 968 of the rotary gearbox 960 define a first travel path 1120 and a second travel path 1122 of the drive belt 1100. The first travel path 1120 includes a first or slide section 1120A between the pulley 1103 and the pulley 1105, and a second or actuator section 1120B between the pulley 1105 and the pulley 968. Similarly, the second travel path 1122 includes a first or slide section 1122A between the pulley 1103 and the pulley 1105, and a second or actuator section 1122B between the pulley 1105 and the pulley 968. In the illustrated embodiments, the pulley 1103 of the first transfer block 1102 is mounted for rotation with respect to the jamb 32''' about an axis that is generally perpendicular to the jamb 32''', and perpendicular to the depth dimension 1123 of the frame 22'''. Pulley 1105 of the second transfer block 1104 is mounted for rotation with respect to the frame 22''' about an axis that is generally parallel to the jamb 32''' and sill 36''', and parallel to the depth dimension 1123 of the frame 22''' (i.e., parallel to the Z-axis). The drive pulley 968 of the rotary gearbox 960 is mounted for rotation with respect to the sill 36''' about an axis that is generally perpendicular to the sill 36''', and perpendicular to the rotational axis of the pulley 1003. The pulleys 1103, 1105 and 968 thereby position the first and second travel paths 1120 and 1122, respectively, of the belt 1100 at locations that are spaced apart from one another along the Z-axis or depth dimension 1123 of the frame 22'''. In the illustrated embodiments the first and second travel paths 1120 and 1122 of the belt 1100 are parallel to one another when viewed from locations perpendicular to the jamb 32''' and sill 36'''. In the illustrated embodiments the slide sections 1120A and 1122A of the first and second travel paths 1120 and 1122, respectively, are parallel to the jamb 32''', and the actuator sections 1120B and 1122B of the first and second travel paths, respectively, are parallel to the sill 36'''.

Drive belt 1100 has a pair of opposed major surfaces defining a width dimension. In the illustrated embodiments, one of the major surfaces of drive belt 1100 is flat, and the other has ribbed teeth. The opposed major surfaces are separated by minor surfaces that define a thickness dimension of the drive belt 1100. The width dimension of the drive belt 1100 is greater than the thickness dimension. The major surfaces of the drive belt 1100 engage the major surfaces of the pulleys 1103, 1105 and 968. Accordingly, and because of the configuration of the pulleys 1103, 1105, each of the portions of the drive belt 1100 extending along the slide sections 1120A and 1122A of the first and second travel paths 1120 and 1122, respectively, rotate 90°. Similarly, and because of the configuration of the pulleys 1105 and 968, each of the portions of the drive belt 1100 extending along the actuator sections 1120B and 1122B of the first and second travel paths 1120 and 1122, respectively, rotate 90°. In the illustrated embodiments, the rotation of the drive belt 1100 along the actuator sections 1120B and 1122B is in the same direction as the rotation along the slide sections 1120A and 1122A, resulting in 180° of rotation of the belt along each of the first and second drive paths 1120 and 1122, respectively, between the turnaround pulley 1103 of the first transfer block 1102 and the drive pulley 968 of the rotary gearbox 960. In the illustrated embodiment, the flat major surface of the drive belt 968 engages the turnaround pulley 1103, and the major surface of the drive belt with the ribbed teeth engages the drive pulley 968 of the rotary gearbox 960.

Figure 27:
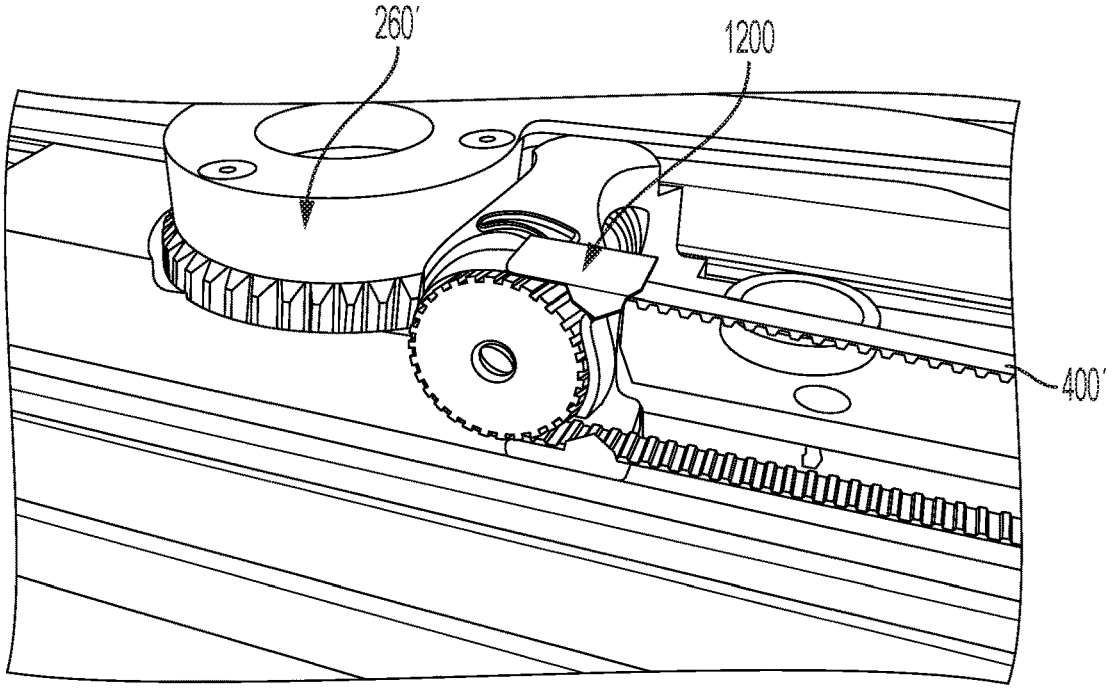
FIGS. 27 and 28 are isometric views of portions of a fenestration unit including a rotary gearbox and belt guide according to additional examples.
Figure 28:
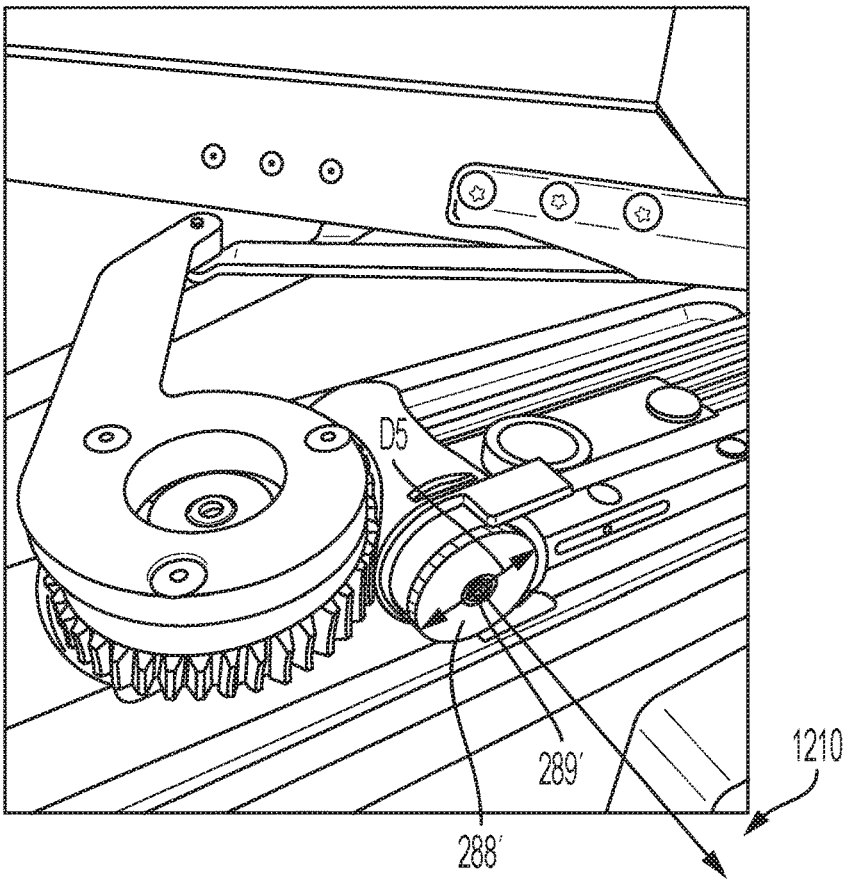
Figure 31:
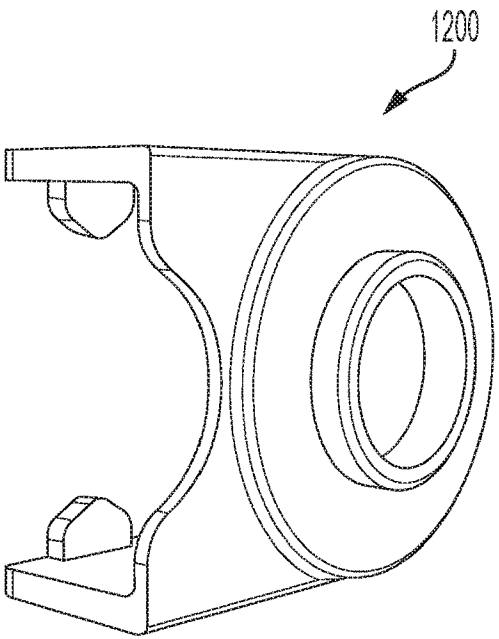
FIGS. 29-31 are isometric views of the belt guide shown in FIGS. 27 and 28.
Figure 30:
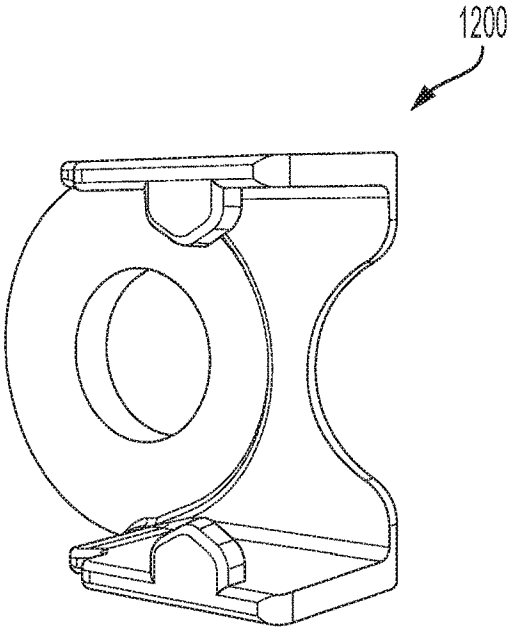
Figure 29:
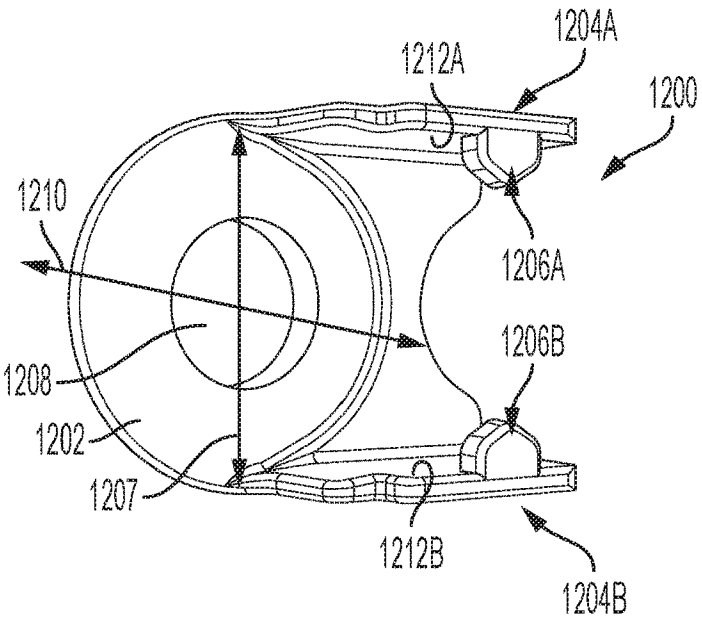

FIGS. 27-31 illustrate a belt guide 1200 in accordance with embodiments. For purposes of example, FIGS. 27 and 28 illustrate the belt guide 1200 mounted for operation on a rotary gearbox 260' of the type described above in connection with FIGS. 9-11. As shown, the belt guide 1200 includes a frame portion 1202, first and second guide members 1204A and 1204B extending from the frame portion, and first and second tabs or edge members 1206A and 1206B extending from the first and second guide members, respectively. The frame portion 1202 is defined by a diameter 1207, and includes an aperture 1208 defining a mounting axis 1210. As shown for example in FIG. 29, the mounting axis 1210 extends through the diameter 1207. As shown in FIGS. 27 and 28, the belt guide 1200 is mounted to the rotary gearbox 260' adjacent to the drive pulley 288', with the drive shaft 289' of the rotary gearbox extending through the aperture 1208 of the frame portion 1202, and the first and second guide members 1204A, 1204B extending over the drive belt 400' (i.e., oriented generally in the direction of the drive belt 400'). Aperture 1208 is sized to allow the drive shaft 289' of the rotary gearbox 260' to rotate in the aperture. As described below, the belt guide 1200 operates to help retain the drive belt 400' on the drive pulley 288' during operation of the rotary gearbox 260'.

The first and second guide members 1204A and 1204B extend from the frame portion 1202 in directions generally transverse to the diameter 1207 at locations spaced apart from the mounting axis 1210. In the illustrated embodiments the first and second guide members 1204A and 1204B extend from from the frame portion 1202 at locations corresponding to the ends of the diameter 1207. The first and second guide members 1204A and 1204B have belt-engaging surfaces 1212A and 1212B, respectively, that face one another. In the illustrated embodiments the belt-engaging surfaces 1212A and 1212B are generally planar and parallel to one another. However, the belt-engaging surfaces 1212A and 1212B take other forms and configurations in other embodiments. In embodiments, the first and second guide members 1204A and 1204B extend over a distance that is at least as great as a radius of the drive pulley 288'. In the illustrated embodiments the first and second guide members 1212A and 1212B extend over a distance that is greater than the radius of the drive pulley 288'. The first and second guide members 1204A and 1204B extend over a length that is less than the radius of the drive pulley 288' in other embodiments (not shown).

In embodiments, the belt-engaging surfaces 1212A and 1212B of the first and second guide members 1204A and 1204B, respectively, are spaced apart from one another by a distance that is greater than (e.g., slightly greater than) a distance separating the outer surfaces of the belt 400 (e.g., a distance greater than a distance equal to the diameter D5 of the drive pully 288' plus two times the thickness portions of the belt 400' that extend beyond the drive pulley). In this manner, the drive belt 400' can move through the belt guide 1200 with no or minimal interference by the belt guide when the drive belt is fully engaged with the drive pully 288'. However, if forces applied by the drive belt 400' to the drive pulley 288' cause one or both lengths of the drive belt to separate from the drive pulley, one or both of the belt-engaging surfaces 1212A, 1212B will engage the belt and help retain the drive belt on the drive pulley. In embodiments, the first and second guide members 1204A, 1204B and/or the belt-engaging surfaces 1212A, 1212B are configured to apply tension to the drive belt 400' at locations spaced from the drive pulley 288' to provide the belt retention functionality. The first and second guide members 1204A, 1204B and/or the belt-engaging surfaces 1212A, 1212B can be configured to apply a greater force to a slack side of the drive belt 400' than a force applied to a tensioned side of the drive belt, in embodiments. In some embodiments the guide members 1204A, 1204B are configured with belt-engaging surfaces 1212A, 1212B that are spaced apart by a distance equal to or less than the spacing between the outer surfaces of the drive belt 400'. In yet other embodiments the guide members 1204A, 1204B are configured with belt-engaging surfaces 1212A, 1212B that are spaced apart by a distance greater than the spacing between the outer surfaces of the drive belt 400' to provide the belt-retaining functionality.

In embodiments of the belt guide 1200 having the edge members 1206A and 1206B, the edge members extend toward one other (i.e., in the direction of the drive belt 400') adjacent to the sides of the drive belt 400'. The edge members 1206A, 1206B, thereby form a channel with the associated guide members 1204A, 1204B and the frame portion 1202, to engage the sides or edges of the drive belt 400' in the event the drive belt slides sideways (e.g., in the direction of the mounting axis 1210) from the drive pulley 288'. The edge members 1206A, 1206B thereby also help retain the drive belt 400' on the drive pulley 288' during operation of the rotary drive member 260'. In embodiments, the edge members 1206A, 1206B are located so as to not engage the drive belt 400' during normal operation of the rotary drive member 260'.

Figure 32:
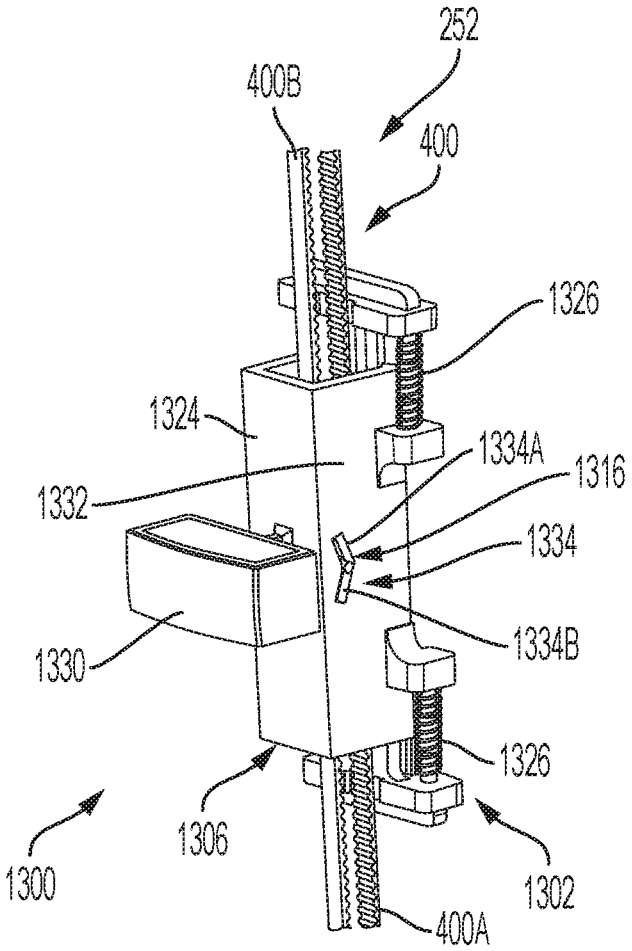
FIG. 32 is an isometric view of portions of a slide mechanism including a belt brake according to additional examples.
Figure 33:
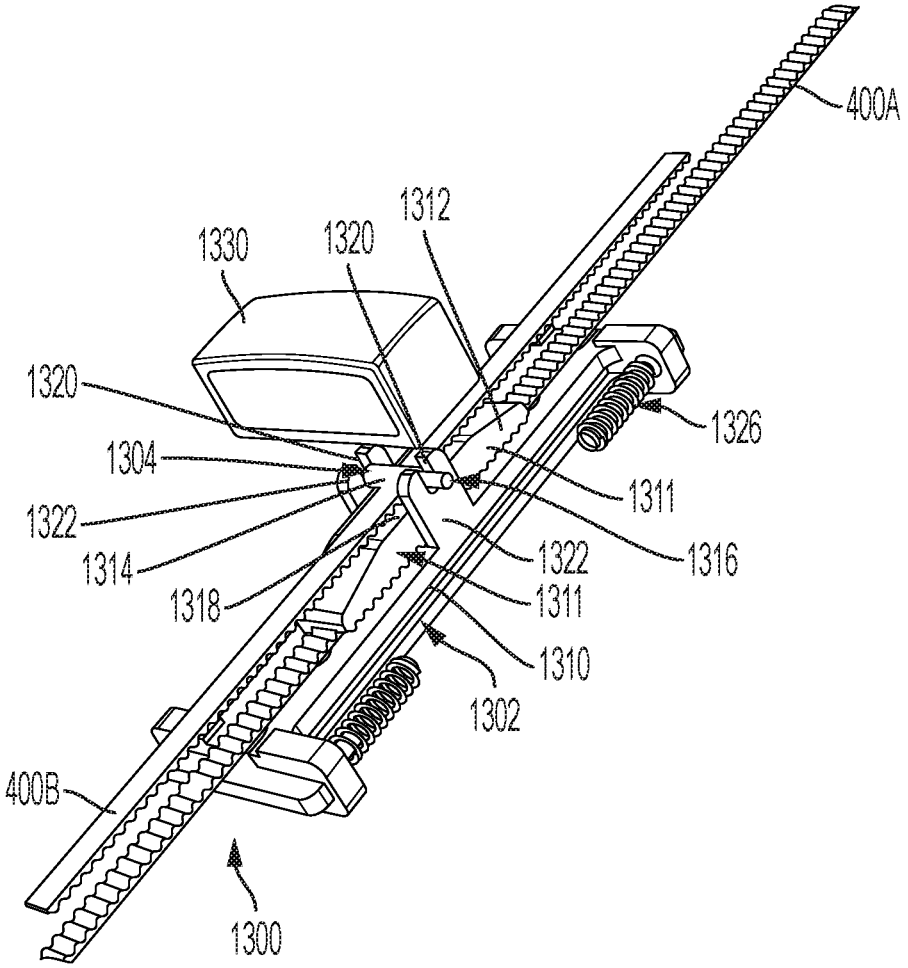
FIG. 33 is a detailed isometric view of the slide mechanism and belt brake shown in FIG. 32, with portions removed.

FIGS. 32 and 33 illustrate a slide mechanism 1300 in accordance with embodiments. For purposes of example, the slide mechanism 1300 is shown attached to the belt 400 of the transfer mechanism 252 described above in connection with FIG. 6, where the belt includes first and second loop portions 400A and 400B, respectively. As shown, the slide mechanism 1300 includes a carriage 1302, a brake 1304, and an actuator 1306 coupled to the brake and carriage. In the illustrated embodiments the carriage 1302 includes a first member 1310 on a first side of the first loop portion 400A of the belt 400 and a second member 1312 on a second side of the first loop portion of the belt (e.g., between the first loop portion and the second loop portion 400B in the illustrated embodiments). Portions of the second member 1312 are secured to the first member 1310 (e.g., by fasteners, not shown) to fixedly engage a first location of the first loop portion 400A of the belt 400 to the carriage 1302. In the embodiments illustrated in FIG. 33 the surface of the second member 1312 includes ribs or teeth that engage the ribbed or toothed side of the belt 400 to enhance the engagement of the belt to the first member 1310. The first member 1310 and second member 1312 thereby cooperate and function as an attachment portion 1311 of the carriage 1302. In other embodiments (not shown), the carriage 1302 is attached to the first location on the loop portion 400A of drive belt 400 by other structures.

Brake 1304 includes a clamp or cylindrical pad 1314 having pins 1316 extending from the opposite sides of the cylindrical pad, and a pad 1318 on the carriage 1302. In the illustrated embodiment the pad 1318 of the brake 1304 includes a surface on the second member 1312 of the carriage 1302. The cylindrical pad 1314 of the brake 1304 is mounted opposite the second loop portion 400B of the belt 400 from the pad 1318. In the illustrated embodiments the pins 1316 of the cylindrical pad 1314 are located in slots 1320 of upright members 1322 extending from opposite sides of the carriage 1302 and belt 400. The cylindrical pad 1314 of the brake 1304 is thereby mounted for reciprocal movement about a path opposite the second loop portion 400B of the belt 400 from the pad 1318 of the brake 1304. In the illustrated embodiments the slots 1320, and therefore the path of movement of the cylindrical pad 1314, are generally perpendicular to the longitudinal axes of the first and second loop portions 400A, 400B of the belt 400.

Actuator 1306 includes a shuttle 1324 that is operatively coupled to the carriage 1302 and the brake 1304. Shuttle 1324 is mounted for motion about the carriage 1302. In the illustrated embodiment the shuttle 1324 (and therefore the actuator) is mounted for reciprocal motion about the carriage 1302. Bias members such as four springs 1326 (only two are visible in FIGS. 32 and 33) bias the shuttle 1324 to a first, center, or unactuated position on the carriage 1302. As described in greater detail below, the shuttle 1324 (and therefore the actuator) can be moved on the carriage 1302 to first and second actuated positions on opposite sides of the unactuated position against the bias forces provided by springs 1326. The illustrated embodiments include a handle 1330 mounted to the shuttle 1324 to facilitate a user's actuation of the shuttle.

The side walls 1332 of the shuttle 1324 (only one side wall is visible in FIG. 32) include cam slots 1334 into which the pins 1316 of the cylindrical pad 1314 of the brake 1304 extend. Each cam slot 1334 has a pair of legs 1334A and 1334B that intersect one another and slope in a direction away from the carriage 1302 with increasing distance from the intersection of the legs. In the illustrated embodiment the cam slots 1334 are V-shaped. The intersection of the legs 1334A, 1334B of the cam slots 1334 (e.g., the base of the V-shaped cam slot in the illustrated embodiments) is located so as to urge the cylindrical pad 1314 into a brake position in engagement with a portion of the loop portion 400B of the belt 400, and to clamp the engaged loop portion 400B of the belt to the pad 1318 of the carriage 1302. The brake 1304 thereby resists or prevents movement of the slide mechanism 1300 and drive belt 400 when the actuator 1306 in the unactuated position.

When a user desires to use the actuator 1306 to move the sash (not shown in FIGS. 32 and 33) between the open and closed positions, the user pushes and slides the actuator (e.g., through use of the handle 1330) in one of the first and second directions to the associated first or second actuated position, respectively. The motion of the actuator 1306 is coupled to the cylindrical pad 1314 through the cam slots 1334, and will cause the cylindrical pad to move to a release position away from the second portion 400B of the belt 400, allowing movement of the belt and opening or closing of the sash. When the actuator 1306 is released, the actuator returns to its unactuated position, driving the brake 1304 back to its brake position. Motion of the actuator 1306 in this manner in a first direction causes the sash to be driven in a first (e.g., opening) direction. Similarly, motion of the actuator 1306 in a second opposite direction causes the sash to be driven in a second (e.g., closing) direction.

Conclusion

Embodiments of the slide operator assemblies and components disclosed herein offer important advantages. For example, they are mechanically robust, can be efficient to manufacture, and convenient to operate.

Although described with reference to preferred embodiments, those of skill in the art will recognize that changes can be made in form and detail without departing from the spirit and scope of the invention.

What is claimed is:

1. A fenestration unit comprising:

a rectangular frame including a first side, a second side opposite the first side, a third side, and fourth side opposite the third side, wherein the third and fourth sides are perpendicular to the first and second sides;

a sash hinged to the first side of the frame and configured to be movable between an open position and a closed position;

a lock assembly including a handle on the second side of the frame;

an operator assembly configured to transition the sash between the open and closed positions, the operator assembly including:

a drive mechanism on the third side of the frame, the drive mechanism configured to impart an opening force on the sash toward the open position and a closing force on the sash toward the closed position;

a slide mechanism on the second side of the frame operatively coupled to the drive mechanism, the slide mechanism being slidable to cause the drive mechanism to impart the opening force and the closing force on the sash; and a transfer mechanism operatively coupling the slide mechanism to the drive mechanism, the transfer mechanism including a linkage member extending over the lock assembly on a side of the lock assembly opposite the second side of the frame.

2. The fenestration unit of claim 1 wherein the linkage member of the transfer mechanism includes a drive belt operatively coupling the slide mechanism to the drive mechanism.

3. The fenestration unit of claim 2 wherein the slide mechanism comprises:

a linear rail on the second side of the frame, between at least portions of the lock assembly and the fourth side of the frame; and a carriage configured for slidable motion along the rail and coupled to the drive belt, wherein the motion of the carriage causes motion of the drive belt.

4. The fenestration unit of claim 3 wherein the transfer mechanism further comprises a plurality of pulleys to support the drive belt about first and second travel paths extending along the second side of the frame, wherein the first travel path is opposite the second travel path from the second side of the frame, and wherein the plurality of pulleys includes one or more jump pulleys to support lock sections of the first and second travel paths on the side of the lock assembly.

5. The fenestration unit of claim 4 wherein:

the plurality of pulleys further includes a first end pulley located between the lock assembly and the fourth side of the frame, wherein the drive belt extends around the first end pulley to define first end portions of the first and second travel paths; and the one or more jump pulleys includes:

a first jump pulley between the lock assembly and the first end pulley, to support the drive belt about a rail section of the second travel path, wherein the rail section of the second travel path is between the lock assembly and the first end pulley;

a second jump pulley between the first jump pulley and the lock assembly, to support the drive belt about a transition section of the second travel path, wherein the transition section of the second travel path is between the rail section and the lock section of the second travel path; and a third jump pulley opposite the lock assembly from the second jump pulley, wherein the second and third jump pulleys support the drive belt about the lock section of the second travel path.

6. The fenestration unit of claim 5 wherein the plurality of pulleys further includes:

a first end pulley opposite the third jump pulley from the lock assembly, to support the drive belt about a second end portion of the first travel path; and a second end pulley opposite the third jump pulley from the lock assembly, to support the drive belt about a second end portion of the second travel path.

7. The fenestration unit of claim 6 wherein the first end pulley, the first, second and third jump pulleys, and the first and second end pulleys are configured to locate the first end portions of the first and second travel paths parallel to one other and spaced apart from one another by a first distance, and to locate the lock and second end portions of the first and second travel paths parallel to one another and spaced apart from one another by a second distance that is less than the first distance.

8. A fenestration unit comprising:

a frame defining a depth dimension and including a head, a first jamb, a second jamb and a sill;

a sash hinged to the frame such that the sash is movable between an open position and a closed position; and an operator assembly configured to transition the sash between the open and closed positions, the operator assembly including:

a drive mechanism including a drive pulley configured to impart an opening force on the sash toward the open position and a closing force on the sash toward the closed position, wherein the drive mechanism is associated with a first axis;

a slide mechanism, wherein the slide mechanism is slidable and associated with a second axis that is a non-zero angle with respect to the first axis; and a transfer mechanism operatively coupling the slide mechanism to the drive pulley of the drive mechanism, the transfer mechanism comprising a plurality of pulleys to support a drive belt about first and second travel paths extending along the first and second axes, wherein the first and second travel paths are spaced from one another about the depth dimension, wherein the plurality of pulleys of the transfer mechanism includes: an end pulley, wherein drive belt extends around the end pulley to define slide portions of the first and second travel paths associated with the slide mechanism; and a corner pulley, wherein the drive belt extends around the corner pulley to define actuator portions of the first and second travel paths associated with the drive mechanism, and that extend from the slide portions to the drive mechanism, wherein, wherein the end pulley is configured for rotation about an axis perpendicular to the depth dimension, and the corner pulley is configured for rotation about an axis perpendicular to the axis of rotation of the end pulley and parallel to the depth dimension.

9. The fenestration unit of claim 8, wherein the drive belt is defined by a thickness and a major surface having a width that is greater than the thickness, and wherein the major surface of the drive belt engages the end pulley and the corner pulley, causing the belt to rotate ninety degrees between the end pulley and the corner pulley.

10. The fenestration unit of claim 9, wherein the drive pulley of the drive mechanism is configured for rotation about an axis perpendicular to the depth dimension, causing the belt to rotate ninety degrees between the corner pulley and the drive pulley.

11. The fenestration unit of claim 10, wherein the first and second axes are perpendicular to one another.

12. A fenestration unit comprising:

a frame including a head, a first jamb, a second jamb, and a sill;

a sash hinged to the frame such that the sash is movable between an open position and a closed position; and an operator assembly configured to transition the sash between the open and closed positions, the operator assembly including:

a drive mechanism including a drive pulley defined by a radius and a diameter and configured for rotation about a drive axis, the drive mechanism configured to impart an opening force on the sash toward the open position and a closing force on the sash toward the closed position in response to rotation of the drive pulley;

a transfer mechanism including a drive belt coupled to the drive pulley, wherein the drive belt rotates the pulley;

an actuator operatively coupled to the drive belt, the actuator being operable to drive the drive belt to cause the drive mechanism to impart the opening force and the closing force on the sash; and a belt guide including:

a frame portion defined by a diameter and including an aperture defining a mounting axis, wherein the mounting axis extends through the diameter and the frame portion and the frame portion is mounted to the shaft of the drive mechanism adjacent to the drive pulley with the shaft extending through and rotatable in the aperture; and first and second guide members including belt-engaging surfaces, the first and second guide members extending from the frame portion at locations spaced from the mounting axis and in a direction transverse to the diameter, wherein the first and second guide members are configured to engage outer surfaces of the drive belt and to retain the drive belt on the drive pulley during operation of the drive mechanism.

13. The fenestration unit of claim 12, wherein the belt-engaging surfaces of the first and second guide members are generally parallel to one another.

14. The fenestration unit of claim 12, wherein the belt-engaging surfaces of the first and second guide members are spaced from one another by a distance at least as great as a distance between the outer surfaces of the drive belt on the drive pulley.

15. The fenestration unit of claim 14, wherein the belt-engaging surfaces of the first and second guide members are spaced from one another by a distance greater than the distance between outer surfaces of the drive belt on the drive pulley.

16. The fenestration unit of claim 12, wherein the first and second guide members extend from the frame portion by distances at least as great as the radius of the drive pulley.

17. The fenestration unit of claim 16, wherein the first and second guide members extend from the frame portion by distances greater than the radius of the drive pulley.

18. The fenestration unit of claim 12 and further including first and second edge members extending from the first and second guide members, respectively, the first and second edge members configured to engage sides of the drive belt and to retain the drive belt on the drive pulley during operation of the drive mechanism.

19. The fenestration unit of claim 12, wherein the first and second guide members are configured to apply tension to the drive belt at locations spaced from the drive pulley during operation of the drive mechanism.

20. The fenestration unit of claim 12, wherein the belt-engaging surfaces of the first and second guide members are configured to allow the belt guide to rotate about the guide rotational axis and to apply a greater force to a slack side of the drive belt than a force applied to a tensioned side of the drive belt.

21. The fenestration unit of claim 12, wherein the drive belt is a toothed belt.

* * * * *